US011814835B2

(12) United States Patent
Argyrou

(10) Patent No.: US 11,814,835 B2
(45) Date of Patent: Nov. 14, 2023

(54) METHODS AND APPARATUS FOR CONSTRUCTING MULTI-STOREY BUILDINGS

(71) Applicant: Hickory Design Pty Ltd, Melbourne (AU)

(72) Inventor: George Argyrou, Elwood (AU)

(73) Assignee: Hickory Design Pty Ltd, Melbourne (AU)

( * ) Notice: Subject to any disclaimer, the term of this patent is extended or adjusted under 35 U.S.C. 154(b) by 169 days.

(21) Appl. No.: 16/311,766

(22) PCT Filed: Jan. 27, 2017

(86) PCT No.: PCT/AU2017/050064
§ 371 (c)(1),
(2) Date: Dec. 20, 2018

(87) PCT Pub. No.: WO2017/219064
PCT Pub. Date: Dec. 28, 2017

(65) Prior Publication Data

US 2019/0211544 A1 Jul. 11, 2019

(30) Foreign Application Priority Data

Jun. 23, 2016 (AU) ..... 2016902460
Aug. 1, 2016 (AU) ..... 2016903025

(51) Int. Cl.
*E04B 1/20* (2006.01)
*E04B 1/34* (2006.01)
(Continued)

(52) U.S. Cl.
CPC ..... *E04B 1/34815* (2013.01); *E04B 1/34823* (2013.01); *E04B 5/04* (2013.01);
(Continued)

(58) Field of Classification Search
CPC .... E04B 1/20; E04B 1/34815; E04B 1/34823; E04B 1/3483; E04B 1/34853; E04B 5/04;
(Continued)

(56) References Cited

U.S. PATENT DOCUMENTS 3,300,943 A * 1/1967 Owens ..... E04B 1/355 52/432
3,568,380 A * 3/1971 Stucky ..... E04B 1/34815 52/223.13
(Continued)

FOREIGN PATENT DOCUMENTS

CA 933376 A 9/1973
CN 110439259 A * 11/2019
(Continued)

OTHER PUBLICATIONS

International Search Report for Application No. PCT/AU2017/050064 dated Jun. 30, 2017 (5 pages).
(Continued)

*Primary Examiner* — Ryan D Kwiecinski
(74) *Attorney, Agent, or Firm* — Michael Best & Friedrich LLP

(57) ABSTRACT

The invention provides a method of constructing a modular multi-storey building including: assembling first and second building modules in a vertical arrangement at an 5 installation location to form a multi-storey building structure, wherein temporary support members between the first and second building modules vertically support at least part of the second building module above the first building module; installing a permanent support structure 10 and connecting it to the first and second building modules to vertically support the second building module above the first building module; and removing the temporary support members.

20 Claims, 28 Drawing Sheets

(51) Int. Cl.

| | |
|---|---|
| ***E04B 5/04*** | (2006.01) |
| ***E04B 2/94*** | (2006.01) |
| ***E04G 11/48*** | (2006.01) |
| ***E04B 1/348*** | (2006.01) |
| ***E04B 5/23*** | (2006.01) |
| ***E04B 5/38*** | (2006.01) |
| ***E04G 21/12*** | (2006.01) |
| ***E04B 5/18*** | (2006.01) |
| ***E04G 11/56*** | (2006.01) |
| *E04C 5/08* | (2006.01) |

(52) U.S. Cl.
CPC ..... *E04B 5/18* (2013.01); *E04B 5/23* (2013.01); *E04B 5/38* (2013.01); *E04G 11/48* (2013.01); *E04G 11/483* (2013.01); *E04G 11/56* (2013.01); *E04G 21/12* (2013.01); *E04B 1/20* (2013.01); *E04B 2103/02* (2013.01); *E04C 5/08* (2013.01)

(58) Field of Classification Search
CPC ..... E04B 5/23; E04B 5/38; E04B 2005/176; E04B 2/94; E04G 11/48; E04G 11/483; E04G 2025/003; E04G 25/04
See application file for complete search history.

(56) References Cited

U.S. PATENT DOCUMENTS

| | | | | |
|---|---|---|---|---|
| 3,613,325 | A | 10/1971 | Yee | |
| 3,918,222 | A | 11/1975 | Bahramian | |
| 4,023,315 | A * | 5/1977 | Stucky | E04G 21/12 52/234 |
| 4,147,009 | A | 4/1979 | Watry | |
| 4,221,098 | A | 9/1980 | Mayer et al. | |
| 4,435,927 | A * | 3/1984 | Umezu | E04B 1/3483 52/235 |
| 4,443,985 | A | 4/1984 | Moreno | |
| 4,470,227 | A * | 9/1984 | Bigelow, Jr. | E04B 1/34869 52/234 |
| 4,546,530 | A * | 10/1985 | Rizk | E04B 1/3483 29/430 |
| 5,224,321 | A | 7/1993 | Fearn | |
| 6,223,480 | B1 | 5/2001 | Khoo | |
| 6,625,943 | B1 * | 9/2003 | Renner | E04B 5/12 52/319 |
| 6,651,393 | B2 * | 11/2003 | Don | E04B 1/3483 52/234 |
| 7,581,709 | B2 * | 9/2009 | Gillespie | E04G 11/38 249/19 |
| 8,291,675 | B2 | 10/2012 | Tikhovskiy | |
| 8,336,276 | B2 * | 12/2012 | Tikhovskiy | E04B 5/28 52/236.8 |
| 9,371,648 | B1 * | 6/2016 | Tikhovskiy | E04B 5/046 |
| 9,487,943 | B2 * | 11/2016 | Bui | E04B 1/21 |
| 10,066,390 | B2 * | 9/2018 | Pospisil | E04B 1/24 |
| 10,260,224 | B1 * | 4/2019 | Jazzar | E04G 11/38 |
| 10,501,948 | B2 * | 12/2019 | Lizarazu Zaldua | E04G 11/486 |
| 2012/0167502 | A1 | 7/2012 | Tikhovskiy | |
| 2013/0055671 | A1 * | 3/2013 | Bruce | E04C 3/08 52/645 |
| 2013/0305629 | A1 * | 11/2013 | Stephenson | E04B 1/3483 52/79.9 |
| 2014/0298745 | A1 * | 10/2014 | Rechenmacher | E04H 1/005 52/425 |
| 2015/0308096 | A1 | 10/2015 | Merhi et al. | |
| 2016/0251853 | A1 * | 9/2016 | Rubel | E04B 5/04 52/745.13 |
| 2021/0376261 | A1 * | 12/2021 | Boudreault | C09K 11/06 |

FOREIGN PATENT DOCUMENTS

| | | | | |
|---|---|---|---|---|
| DE | 102016012237 | A1 * | 7/2018 | |
| EP | 1184521 | A1 * | 3/2002 | E04B 1/34823 |
| FR | 2901820 | A1 * | 12/2007 | E04H 15/18 |
| GB | 1101597 | A | 1/1968 | |
| GB | 1271024 | A | 4/1972 | |
| GB | 1350599 | A | 4/1974 | |
| KR | 100873846 | | 12/2008 | |
| KR | 20130083100 | A | 7/2013 | |
| RU | 2376424 | C1 | 12/2009 | |
| WO | 2005108700 | | 11/2005 | |
| WO | 2011106842 | | 9/2011 | |
| WO | 2012045149 | A1 | 4/2012 | |
| WO | WO-2012070281 | A1 * | 5/2012 | E04B 1/3483 |
| WO | WO-2017093221 | A * | 6/2017 | E04G 11/483 |
| WO | WO-2017093221 | A1 * | 6/2017 | E04G 11/483 |
| WO | WO-2019034279 | A1 * | 2/2019 | E04B 1/34315 |

OTHER PUBLICATIONS

International Preliminary Report on Patentability for Application No. PCT/AU2017/050064 dated Oct. 22, 2018 (85 pages).
International Search Report for related Application No. PCT/AU2017/050063 dated May 4, 2017 (4 Pages).
International Search Report for related Application No. PCT/AU2017/050546 dated Sep. 29, 2017 (5 Pages).
Examination Report issued from the Australian Patent Office for related Application No. 2017282720 dated Dec. 13, 2021 (5 Pages).
Examination Report issued from the Australian Patent Office for related Application No. 2017280086 dated Dec. 21, 2021 (4 Pages).

* cited by examiner

METHODS AND APPARATUS FOR CONSTRUCTING MULTI-STOREY BUILDINGS

FIELD OF THE INVENTION

The invention relates to methods and apparatus for constructing buildings, in particular buildings constructed using modular units.

BACKGROUND OF THE INVENTION

In the construction industry modular buildings are becoming more popular due to their ability to be constructed on site in shorter timeframes than traditional multi-storey construction. Modular construction involves building and preparing a building module offsite in a factory before transporting and installing the module at an installation location. Despite the time saving benefits of modular construction techniques there is a constant pursuit to improve these methods of construction with the aim of achieving time savings and cost savings in the overall construction of the building.

It is in light of these pursuits for efficiencies in current the construction of modular buildings that the invention was conceived.

SUMMARY OF THE INVENTION

The invention provides a method of constructing a modular multi-storey building including: assembling first and second building modules in a vertical arrangement at an installation location to form a multi-storey building structure, wherein temporary support members between the first and second building modules vertically support at least part of the second building module above the first building module; installing a permanent support structure and connecting it to the first and second building modules to vertically support the second building module above the first building module; and removing the temporary support members.

By providing a method in which the temporary support members can be removed it is possible to salvage and reuse building materials, such as steel supports, that becomes redundant once permanent support structures are installed.

The term building module is intended to refer to a construction unit that is created off site, for example in a factory setting, and is transported on site to be assembled with other building modules to construct a multi-storey building. The building module could include a basic form comprising a base and a frame fixed to the base that forms the 'bones' of walls and a ceiling.

Alternatively, the building module may comprise a unit in an almost finished state including base, walls, ceiling and even fixtures. Further still, the building module may include a construction falling between the basic and the almost finished forms discussed above.

In an embodiment the method includes at least partially constructing the first building module at a first location before assembling the first and second building modules at the installation location. The temporary support members may be attached to the first building module at the first location. A bracket may be attached to one or more of the temporary support members. A wall structure may be attached to the bracket. The bracket may be attached to the second building module.

In an embodiment the permanent support structure is installed after the second building module has been assembled at the installation location.

By providing a method in which the second building module can be installed before the permanent support structure is installed the installation of building modules can be decoupled from the supply of the permanent support structures.

In an embodiment a third building module is assembled above the second building module before the permanent support structure is connected to the first and second building modules. The third building module may be assembled above the second building module using temporary support members.

In an embodiment a concrete slab is cast to form a base of the first building module. In an embodiment a concrete slab is cast to form a base of the second building module. The base of the second building module may be cast to include a steel beam at least partially embedded into the base of the second building module. The steel beam of the base of the second building module may be located on a locator on one or more of the temporary support members.

In an embodiment concrete is poured to connect the first building module to the permanent support member. In an embodiment concrete is poured to connect the second building module to the permanent support member.

In an embodiment a tripod-type temporary support member is attached to the first building module. In an embodiment the temporary support members are re-used.

Also described herein is a method of constructing a modular building including the steps of:

a) constructing first, second and third building modules;
b) mounting temporary support members to each of the first and second building modules;
c) installing the first building module into the modular building;
d) mounting the second building module to one or more of the temporary support members of the first building module so that at least part of the second building module is supported above the first building module;
e) mounting the third building module to one or more of the temporary support members of the second building module so that at least part of the third building module is supported above the second building module;
f) installing a permanent support member to permanently support the second building module above the first building module, and to permanently support the third building module above the second building module; and
g) removing the temporary support members from the first building module after step e).

The invention also provides a formwork assembly comprising: a first bracket having an elongate body, the elongate body having an attaching section to attach the first bracket to a building structure and a supporting section, the supporting section having a supporting means; a second bracket having an attaching section to attach the second bracket to a building structure and a supporting section, the supporting section having a supporting means; and a mesh made from reinforcing steel bar, the mesh being supported by the supporting means of the first bracket and the supporting means of the second bracket.

In an embodiment the supporting means are open ended slots. The open ended slots may be angled downwards. The horizontal sections of the mesh may be located in the open ended slots. The opened ended slots in the first and second brackets may be spaced apart so that each horizontal section of the mesh has a corresponding slot.

In an embodiment the first and second brackets are attached to a single common building structure. The common building structure may be a building module.

In an embodiment described herein there is a method of constructing a modular building including the steps of:

a) constructing a base of a first building module;
b) mounting a first end of a temporary support member to the base of the first building module;
c) installing the first building module into the modular building;
d) mounting a second building module to a second end of the temporary support member so that at least part of the second building module is supported by the temporary support member;
e) installing a permanent support member between the first building module and the second building module to support the second building module above the first building module; and
f) removing the temporary support member from the first building module.

A bracket can be attached to the second end of the temporary support member, and the second building module can be attached to the temporary support member via the bracket.

An aperture in the bracket can be aligned with a bracket locator on the temporary support member when attaching a bracket to the second end of the temporary support member.

The base of the first building module can be constructed at a first location, and then transported from the first location to an installation location, where the building module is installed. The temporary support member can be attached to the base of the first building module before the first building module is transported to the installation location.

A wall panel can be attached to the first building module. Preferably the wall panel is attached to the base and the bracket. The wall panel can be attached before the first building module is transported to an installation location.

A height of the temporary support member can be adjusted to a desired height after the temporary support member has been attached to the base of the first building module.

The temporary support member can be detached from the bracket when removing the temporary support structure.

A mesh locator bracket can be installed to the first building module. A prefabricated concrete panel can be installed to connect the first building module to the second building module. Concrete can be poured at the installation location to connect the prefabricated concrete panel to connect the first and second building modules.

The second building module can be installed directly above the first building module. The temporary support members can be reused.

In an embodiment described herein there is a method of constructing a modular building including the steps of:

a) constructing a base of a first building module;
b) attaching a support member to the base of the first building module;
c) installing the first building module;
d) installing a second building module so that at least part of the second building module is supported by the support member;
e) installing, after step d), a prefabricated panel between the first building module and the second building module to support the second building module.

By providing a method in which a second building module is installed before a prefabricated panel is installed to support the second building module the installation of building modules can be decoupled from the supply of walls and other permanent support structures.

The first building module can be part of a first level of the modular building and the second building module is part of a second level of the modular building, and wherein all of the building modules for the first and the second levels are installed before step e) is performed. The base of the first building module can be constructed at a first location, and then transported from the first location to an installation location, where the building module is installed.

Before step e) is performed a third building module can be installed at the installation location so that at least part of the third building module is supported by a second support member, the second support member being attached to the second building module so that at least part of the third building module is supported by the second support member.

Step e) can include pouring concrete at the installation location to connect the prefabricated panel to the first building module. Preferably the prefabricated panel is a prefabricated concrete panel. Step e) can include lowering the prefabricated panel into position between the first building module and the second building module by crane.

The support member can be a temporary support member. The temporary support member can be a temporary support member as described above.

BRIEF DESCRIPTION OF THE DRAWINGS

An embodiment, incorporating all aspects of the invention, will now be described by way of example only with reference to the accompanying drawings in which.

DETAILED DESCRIPTION OF PREFERRED EMBODIMENTS OF THE INVENTION

Figure 1A:
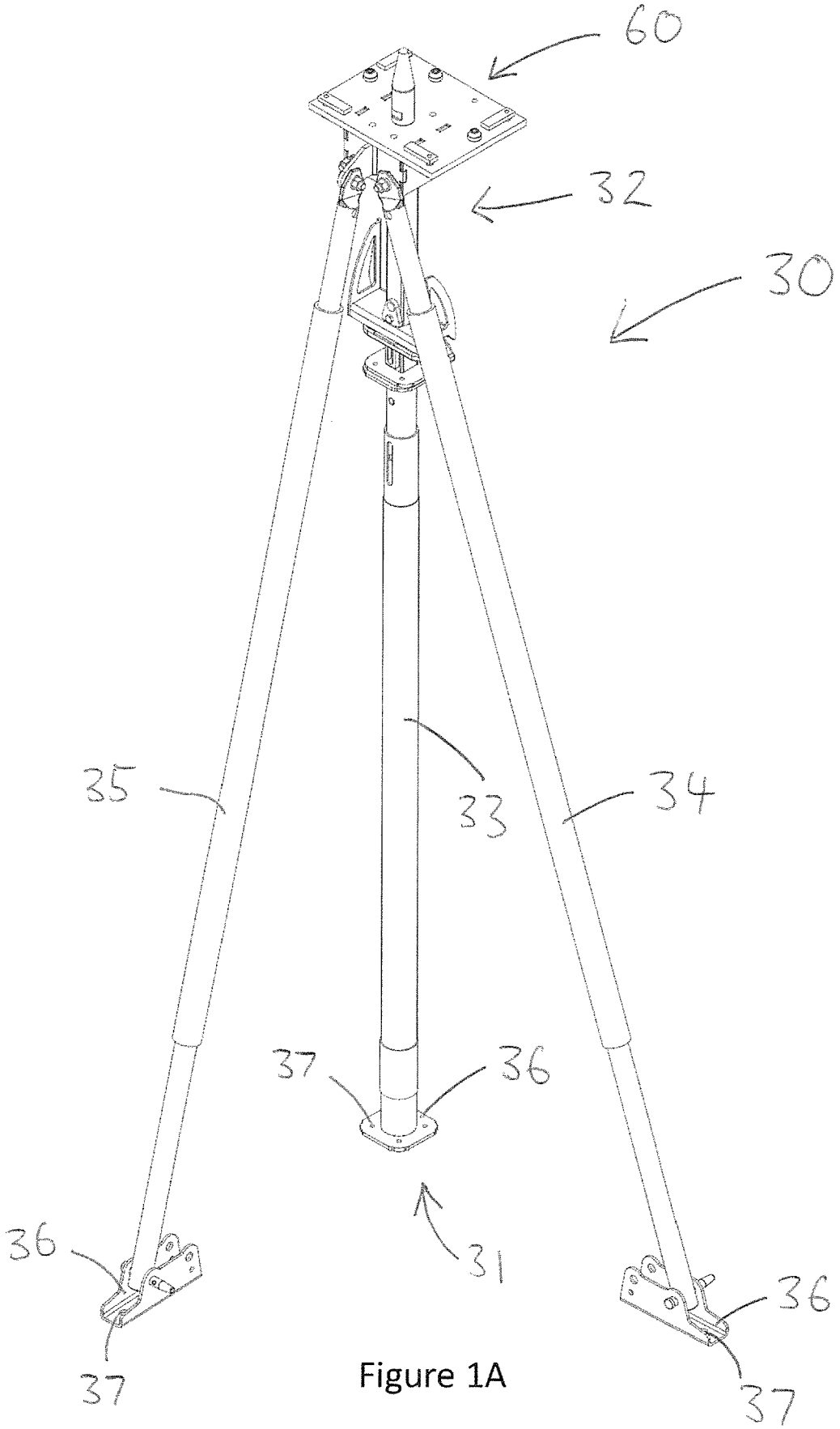
FIG. 1A is an isometric view of a temporary support member in accordance with an embodiment of the invention.
Figure 1B:
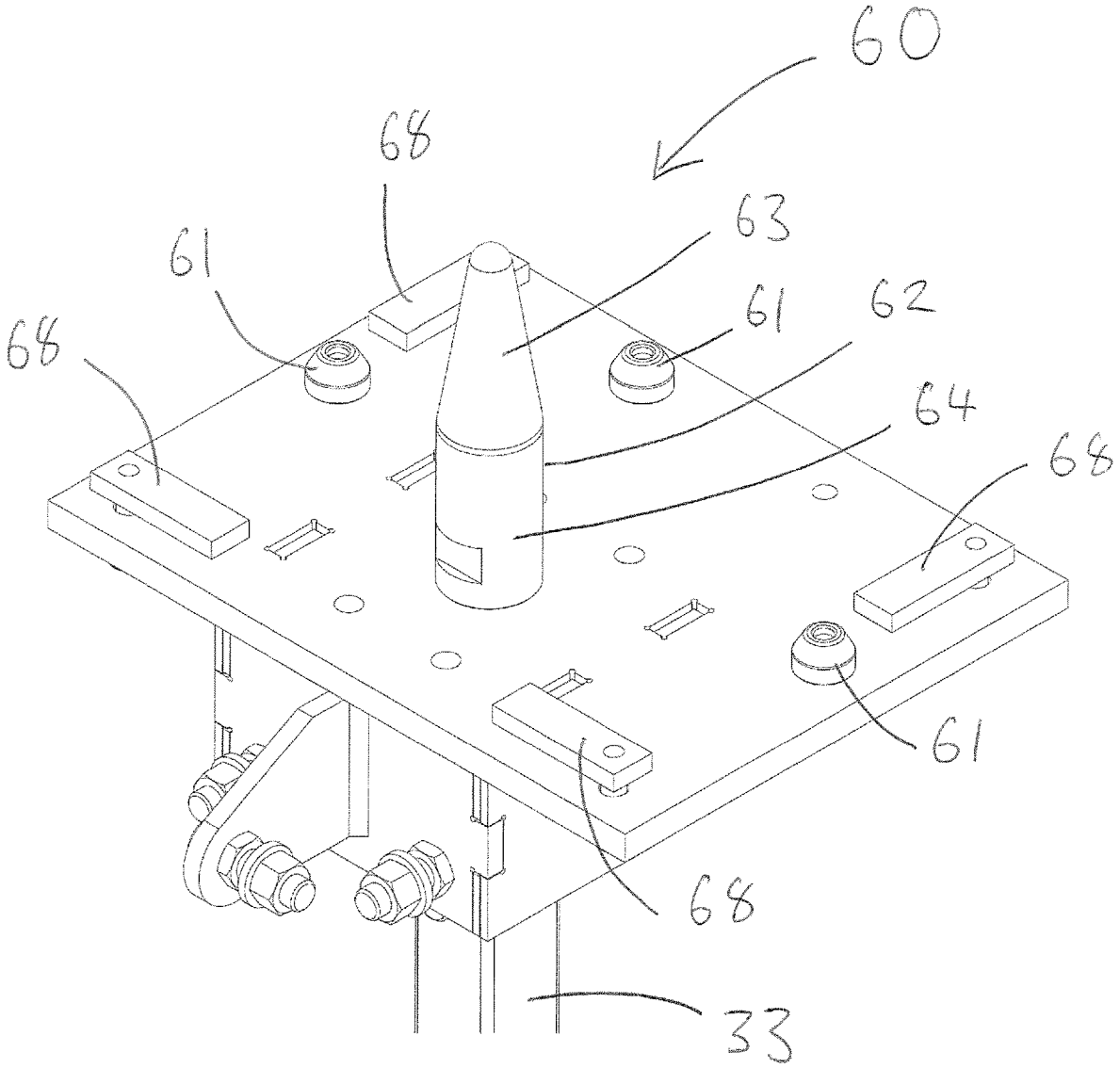
FIG. 1B is an isometric view of a locator plate attached to the temporary support member shown in FIG. 1A.
Figure 1C:
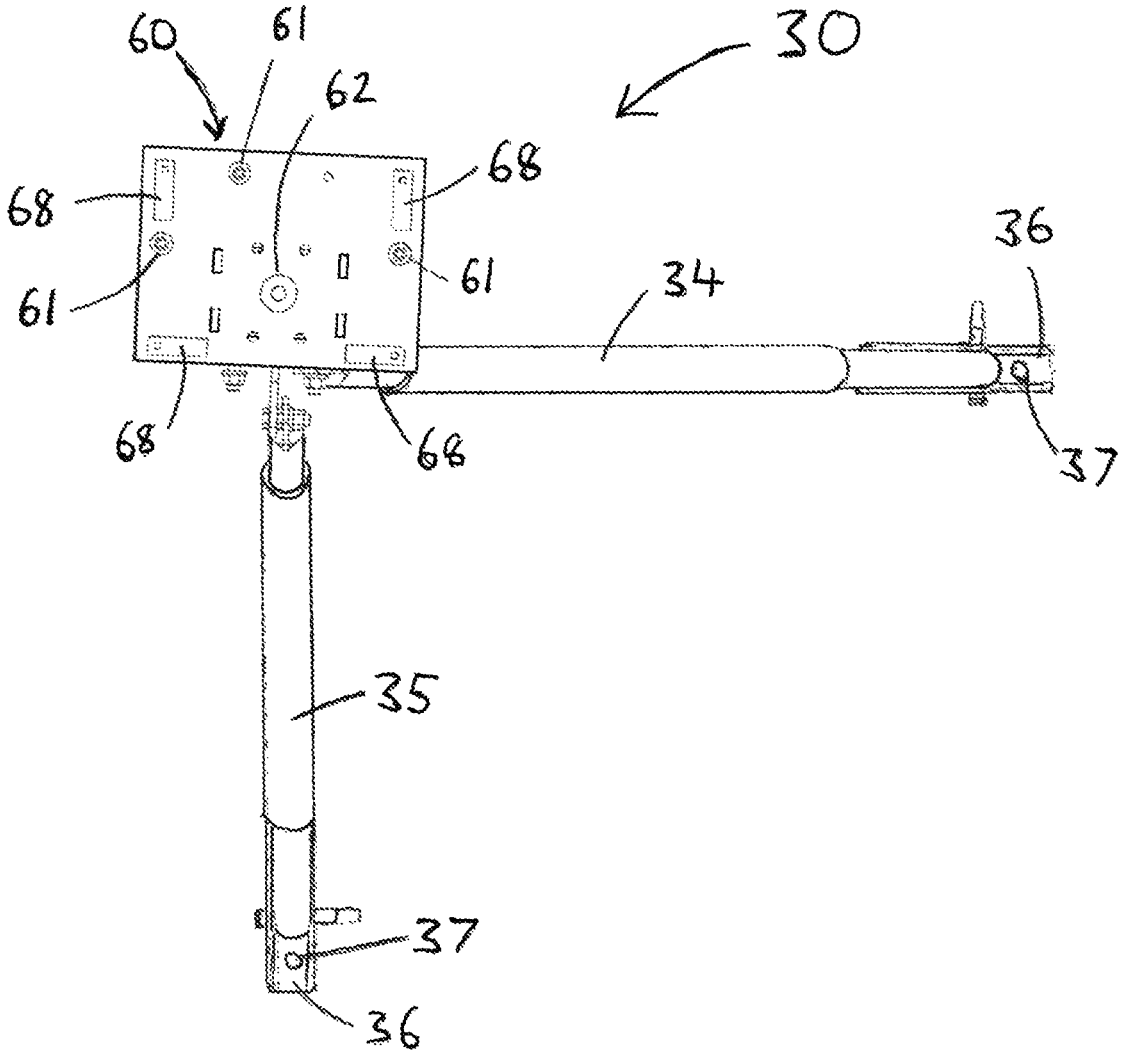
FIG. 1C is a top view of the temporary support member shown in FIG. 1A.
Figure 1D:
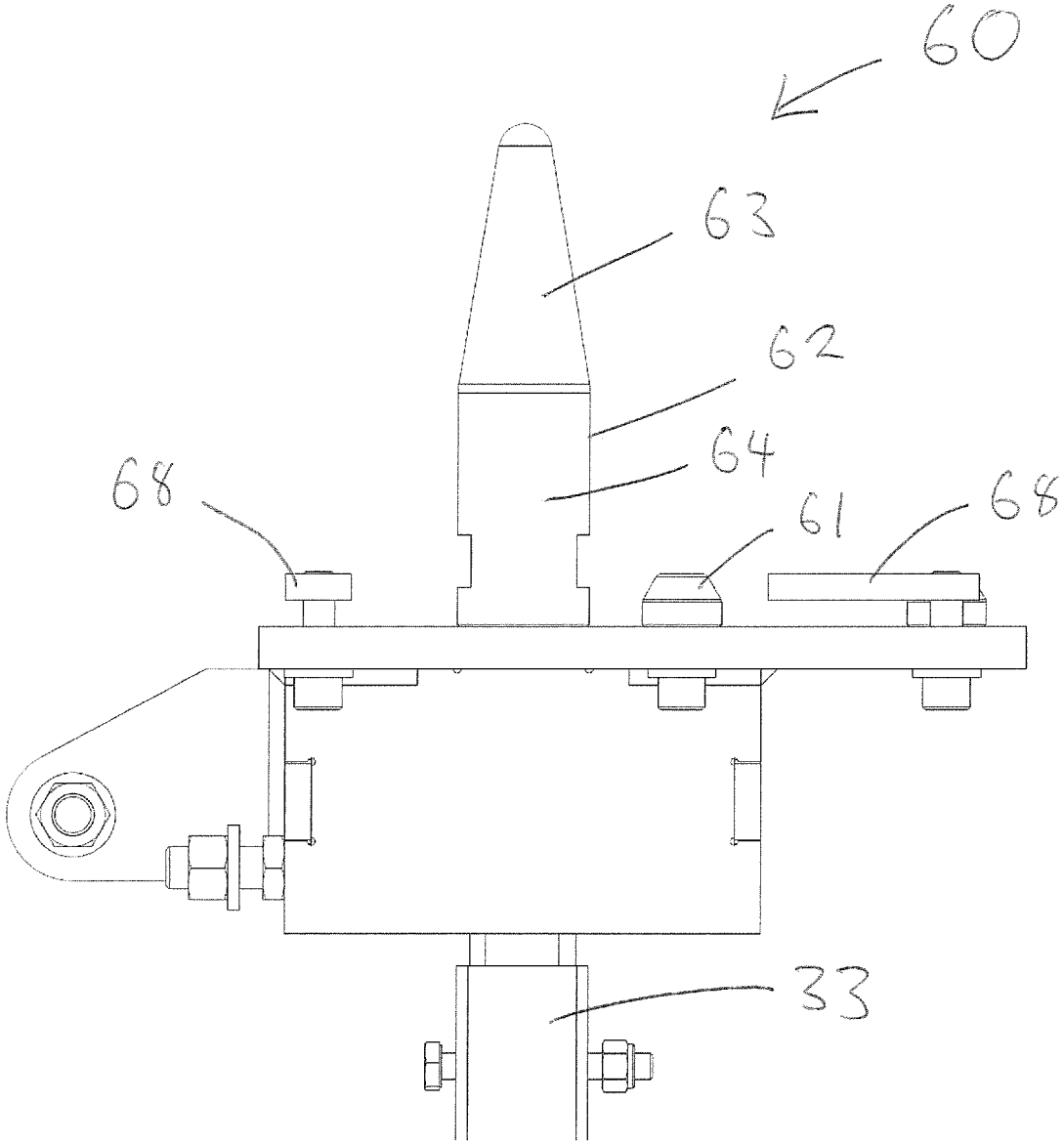
FIG. 1D is a side view of an upper end of the temporary support member in FIG. 1A.
Figure 1E:
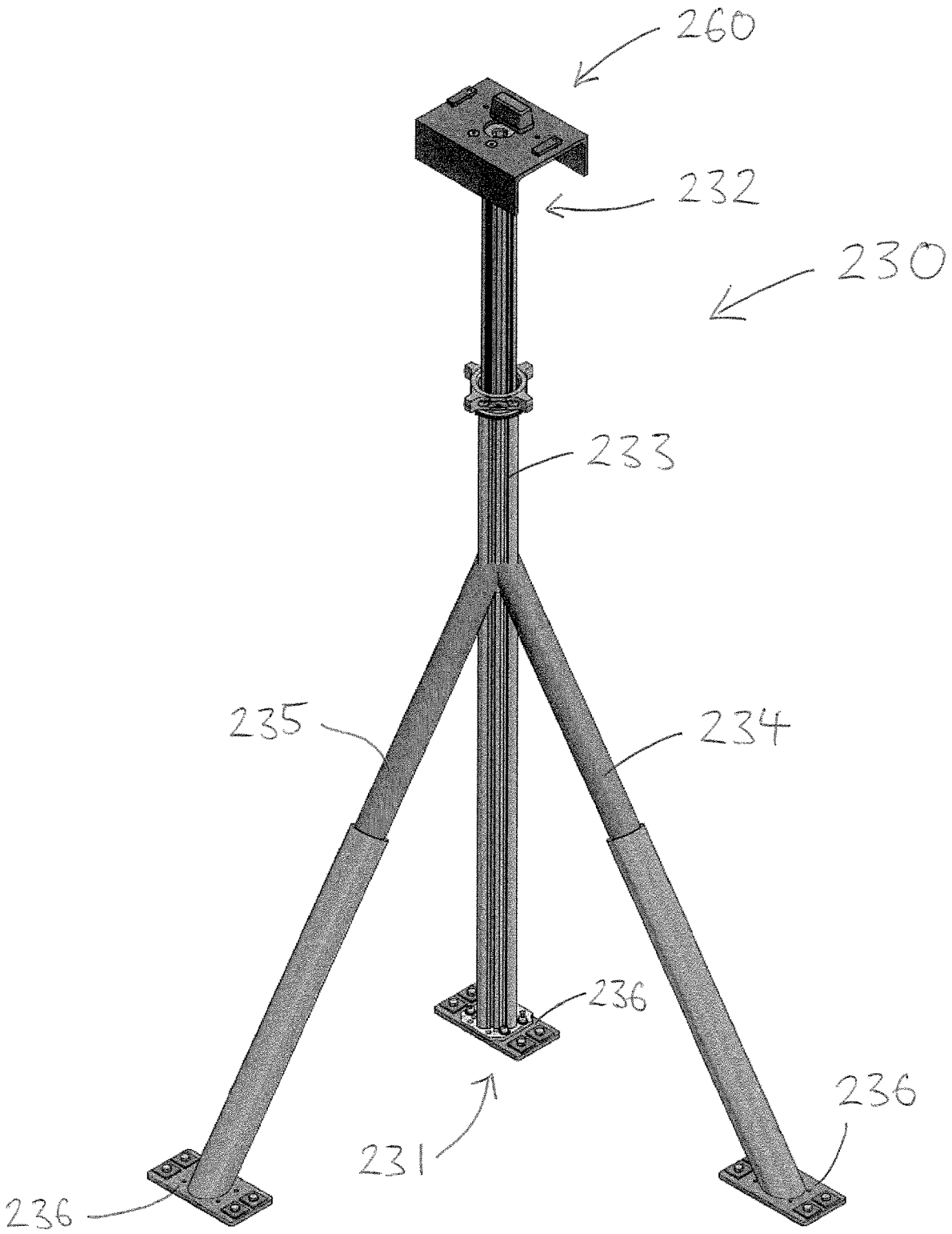
FIG. 1E is an isometric an isometric view of an alternative temporary support member in accordance with an embodiment of the invention.
Figure 1F:
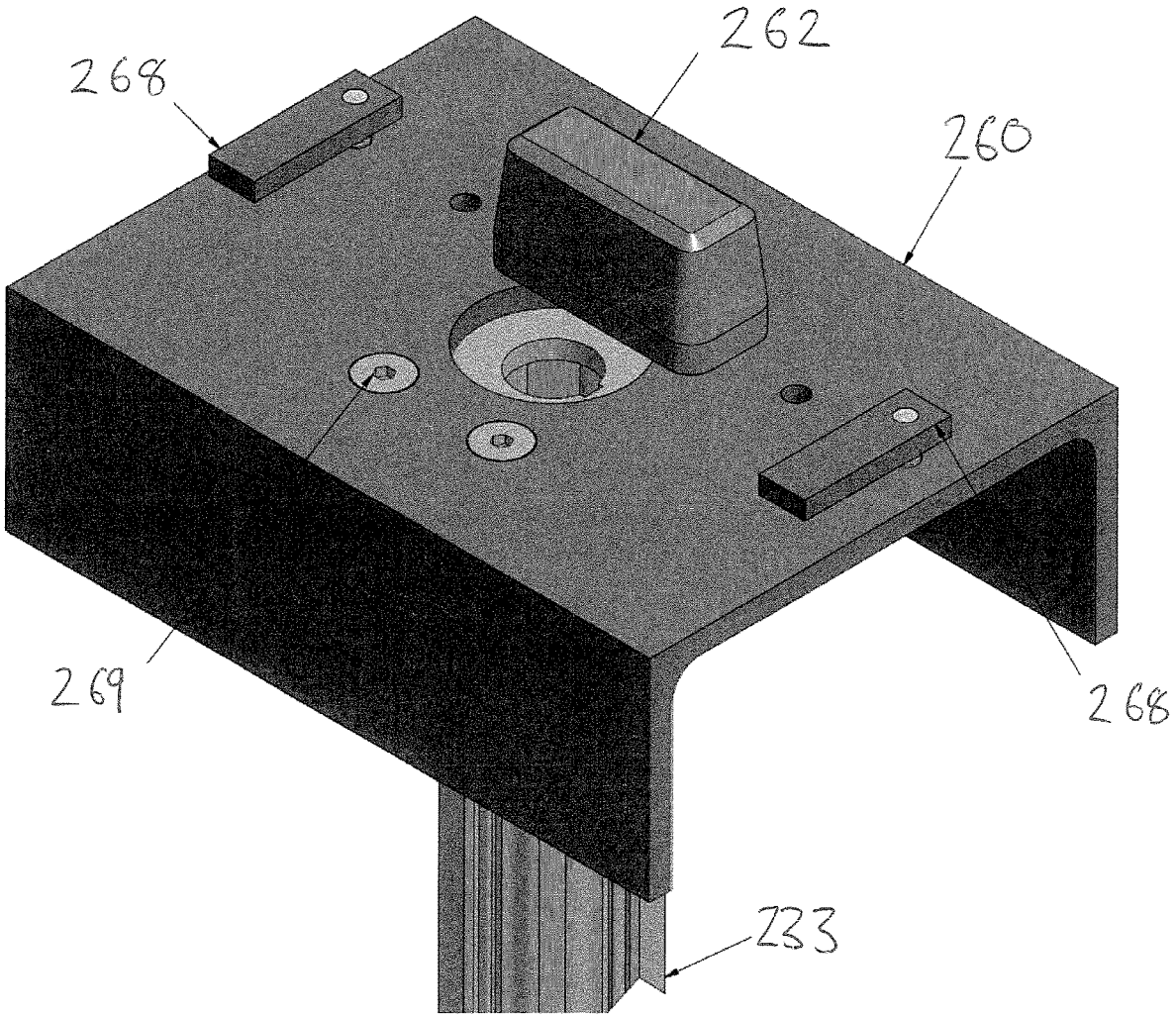
FIG. 1F is an isometric view of a locator plate attached to the temporary support member shown in FIG. 1E.
Figure 1G:
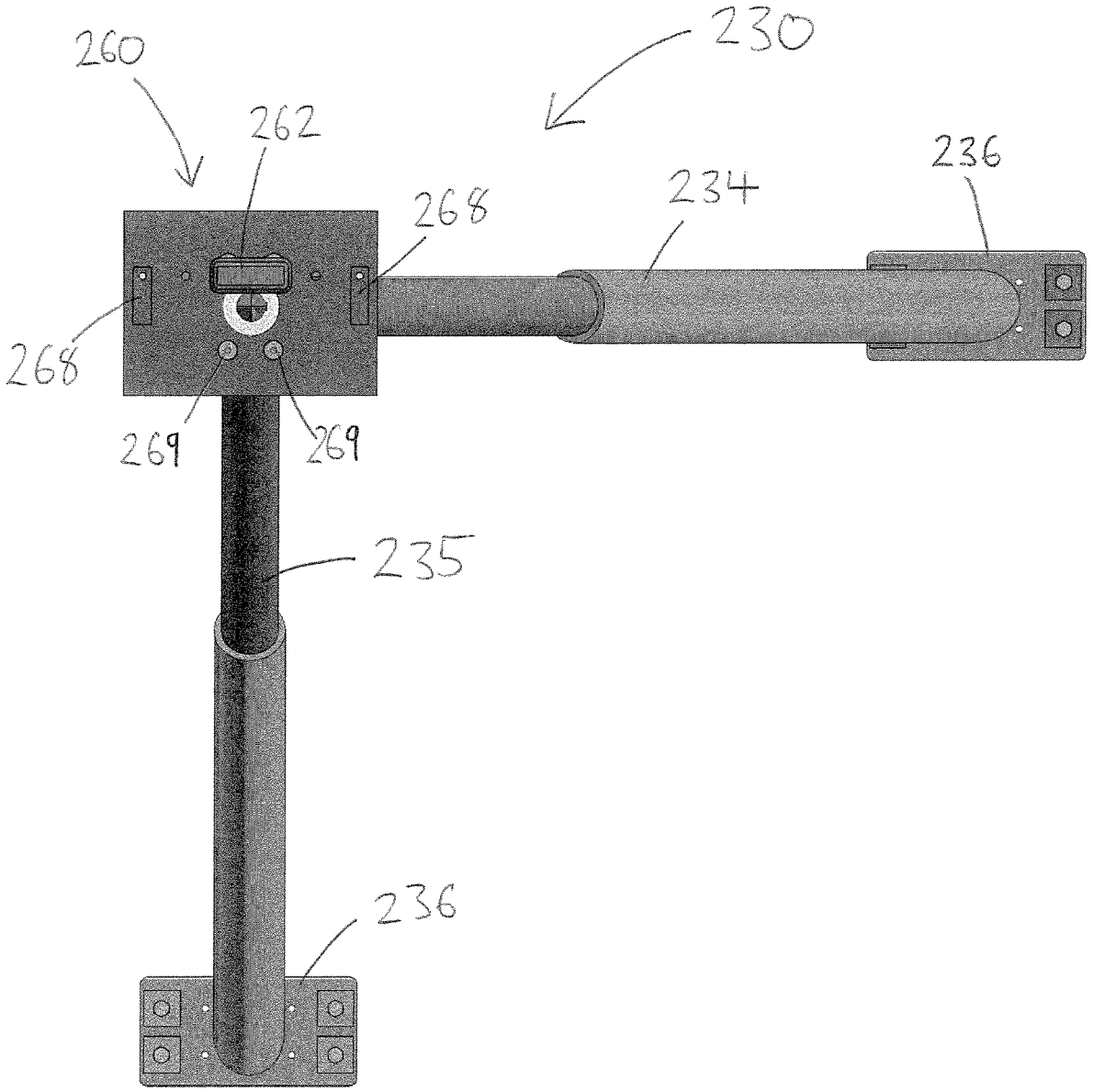
FIGS. 1G and 1H are top and side views of the temporary support member shown in FIG. 1E.
Figure 1H:
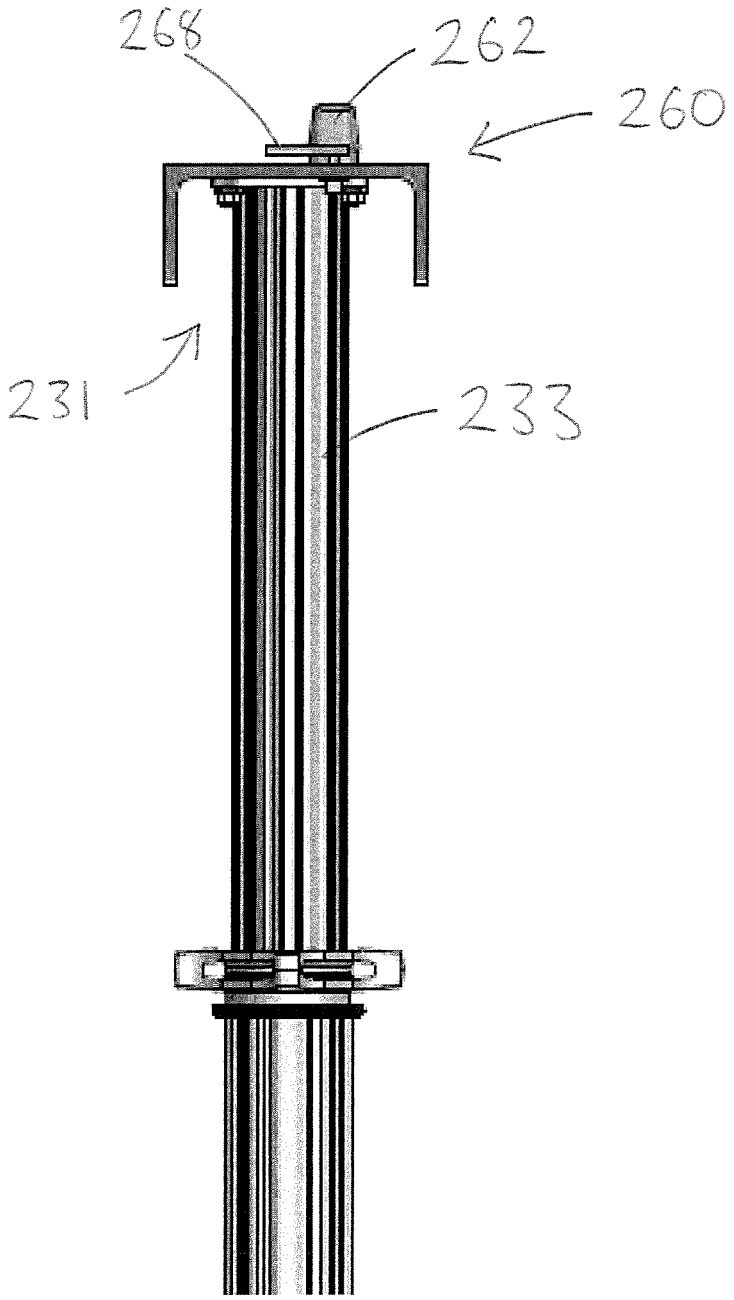

FIGS. 1A to 5D illustrate a method of constructing a modular building 10. The modular building is typically a multi-storey building made of building modules formed off site. The transportation of each module from a first location off site to the installation site and the subsequent construction requires the modules to maintain a certain stability so that they can be handled by cranes and other handling equipment on and off the transportation vehicle, and placed or stacked on site so that they can support other modules placed on top. Such stability requires a base, preferably a cast concrete slab, and support columns placed at strategic locations on the base to be able to support another module placed on top.

The inventor has realised that once the building modules have been installed on site and concrete structure (walls and columns) have been created or erected, the columns traditionally mounted on the base in the factory and that form a permanent part of the finished building, which columns are often formed of steel, can in fact become redundant as the building can be engineered to make the columns non-load bearing. The load in such a building is instead taken by the concrete structure, not the steel columns. The concrete structure can include concrete cores (for lift and stair wells) and shear walls (internal and external).

Accordingly, the method described herein is directed to a technique of providing structural integrity to a building module when required, without sacrificing or wasting structural components, which can be expensive.

In its basic form the method involves assembling building modules in a horizontal and/or vertical arrangement to form a building structure, wherein the modules include temporary supports, such as columns, to be able to support the modules on the next level above or a roof structure above. In describing the temporary support of modules, it is understood that the temporary supports also support the formwork used to install the permanent support structures. This could include the creation of concrete components used to connect and stitch together the modules. Once the modules are in place permanent support members are installed to connect between the lower module and the upper module (or roof) and the temporary support columns are removed (and can be re-used). Permanent supports can include the installation of pre-fabricated load bearing panels, such as concrete panels, or the in situ creation of concrete walls, including core and shear walls, through pouring or spraying ('shotcreting') wet concrete and allowing it to dry. Alternatively, the permanent support members could be steel braced walls, or any other suitable permanent structure.

The temporary support members could include the provision and changeover of more than one type of support structure. For example, if the building module is installed on site comprising a pre-formed base with upstanding steel columns attached thereto, after a second module is placed on top and held spaced above via the steel columns, a removable temporary support (such as the tripod-type discussed further below) for supporting the structure during construction (eg. concrete application) could be positioned between the first and second modules to support the upper module and to support formwork used (in a sacrificial or temporary way) in the in-situ forming of concrete elements including columns, panels or beams. The in-situ concrete elements could form part of the exterior façade of the building, or could form part of a concrete core, or could be the elements laterally and vertically connecting together the building modules.

Once the temporary supports are in place, the steel columns, which served to support the building module during transportation to site and erection, may then be removed (for re-use). The permanent structure is then installed by placement/pouring/spraying, and once the permanent structure, including concrete elements, is set and capable of bearing the load of the upper module, the temporary supports can be removed (and re-used).

Alternatively, it may be suitable to do away with steel columns altogether and instead use only one kind of removable temporary purpose-built support during construction of the multiple levels and installation of the permanent supports. A further alternative could be to employ a combination of temporary steel columns as well as the further temporary purpose-built supports.

Broadly, and referring to FIGS. 3A to 5D, the method includes the following steps:

a) constructing a base 21 of a first building module 20;
b) attaching a first end of a temporary support member, shown as first end 31 of tripod 30, to the base 21 of the first building module 20;
c) installing the first building module 20 on site;
d) attaching a second building module 120, including formwork, to a second end 32 of the tripod 30 so that at least part of the second building module 120 is supported by the tripod 30;
e) installing a permanent support member, such as prefabricated concrete wall 80 or creating a concrete element by applying concrete to formwork, between the first building module 20 and the second building module 120 to support the second building module 120; and f) removing the tripod 30.

It will be appreciated that the temporary support member in the form of a tripod 30 in the described embodiment, acts to space the second building module from the first building module during construction. In this way the second building module, and formwork between the modules, is located in the correct position by the temporary support member until the permanent support member(s) is installed or applied on site. It is the permanent support members that provide the structural integrity to the building. Thereafter the temporary support member may be removed.

It is envisaged that the base 21 of the first building module 20 could be constructed at a first location, and then moved, for example by being transported from the first location to an installation location, where the building module is installed. The first location may be a factory or a warehouse where the initial components of the first building module may be more easily assembled in an assembly line fashion, in order to assist in shortening overall construction time on site at the installation location. It is envisaged that the tripod 30 could be attached to the first building module 20 either before or after the first building module 20 is transported from the first location to an installation location.

Alternatively, if there is room on the building site, an assembly area may be allocated, for example, in an area that is designated as a courtyard or garden in the finished building. In this example the first building module 20 can be constructed on the building site in a designated assembly area before being moved into position, for example by a crane, and installed. Again, is envisaged that the tripod 30 could be attached to the first building module 20 either before or after the first building module 20 is positioned in an installation location. It will be understood that locating the assembly area, or factory, on the building site will help reduce transportation costs.

Referring to FIGS. 2A to 3C, the method may include the step of attaching a bracket, shown as angle bracket 40, to the second end 32 of the tripod 30. The angle bracket 40 can then act as an interface or formwork between the tripod 30 and other building components, such as the second building module 120 or a wall structure. It is envisaged that the wall structure could be an internal wall, a façade wall, or a structure to allow creation of a wall (such as shutters for pouring or spraying concrete walls, or a rebar bracket 140 as described later). If the angle bracket is used then the second building module may be attached to the tripod 30 via angle bracket 40.

FIGS. 1A to 1D illustrate a first embodiment of the tripod 30. The tripod 30 has a main shaft 33 and two auxiliary legs 34, 35 that stabilise the main shaft 33. The main shaft 33 and the two auxiliary legs 34, 35 each have a foot 36 that enables the tripod 30 to be attached to the upper surface or floor 22 of the building module 20. The feet 36, which are at the first end 31 of the tripod 30, have one or more apertures 37 that allow fasteners to be inserted through the feet 36 to fasten and secure the first end 31 of the tripod 30 to the floor 22 of the building module 20. The main shaft 33 is telescopic to allow the height of the tripod 30 to be adjusted as desired The main shaft 33 extends from the first end 31 of the tripod 30 to the second end 32 of the tripod 30. The main shaft 33 is substantially straight along its entire length so that in use the main shaft 33 is substantially vertical when attached to a building module so that it can support a load, usually of at least one storey above, if not more. The two auxiliary legs 34, 35 are spaced 90 degrees from each other about the axial direction of the main shaft 33. In other words, the auxiliary legs 34, 35 lie in orthogonal planes.

A locator plate 60 is attached at the top of the main shaft 33. The locator plate 60 is attached to the top by fasteners, such as bolts, but it could be welded thereto. The locator plate 60 is used to assist in aligning a second building module 120 above the first building module 20. The locator plate 60 has a locator, shown as a protrusion, and more specifically shown as locator pin 62 that extends away from the face of the locator plate 60. The tip 63 of the locator pin 62 convergingly tapers as it extends away from the locator plate 60. In other words, the tip 63 of the locator pin 62 narrows as it extends away from the location plate 60. The locator pin 60 has a cylindrical base 64 that is wider than the tip 63 of the pin 62. The narrower tapered end of the locating pin 62 makes initial positioning of the second building module 120, while the wider base of the locating pin 62 ensures accurate alignment of the second building module 120 on top of the locator plate 60.

FIGS. 1E to 1H illustrate a second embodiment of the tripod 230, with a second embodiment of the locator plate 260, which is attached to the tripod by bolts 269. Clamp nuts 268 serve to secure the angle bracket 40 to the locator plate 260, as discussed below in respect of the embodiment of FIGS. 2A to 2C. The tripod 230 has a main shaft 233 and two auxiliary legs 234, 235 that stabilise the main shaft 233. The main shaft 233 extends from the first end 231 of the tripod 230 to the second end 232 of the tripod 230. Feet 236 are located at the first end 231 of the tripod 230. The locator plate 260 has a locator, shown as a protrusion, and more specifically shown as location block 262 that is elongate in shape and extends away from the face of the locator plate 260. The location block 262 convergingly tapers as it extends away from the locator plate 260. In other words, the location block narrows as it extends away from the location plate 260. The location block is wider than it is thick, to assist in precise alignment.

Figure 2A:
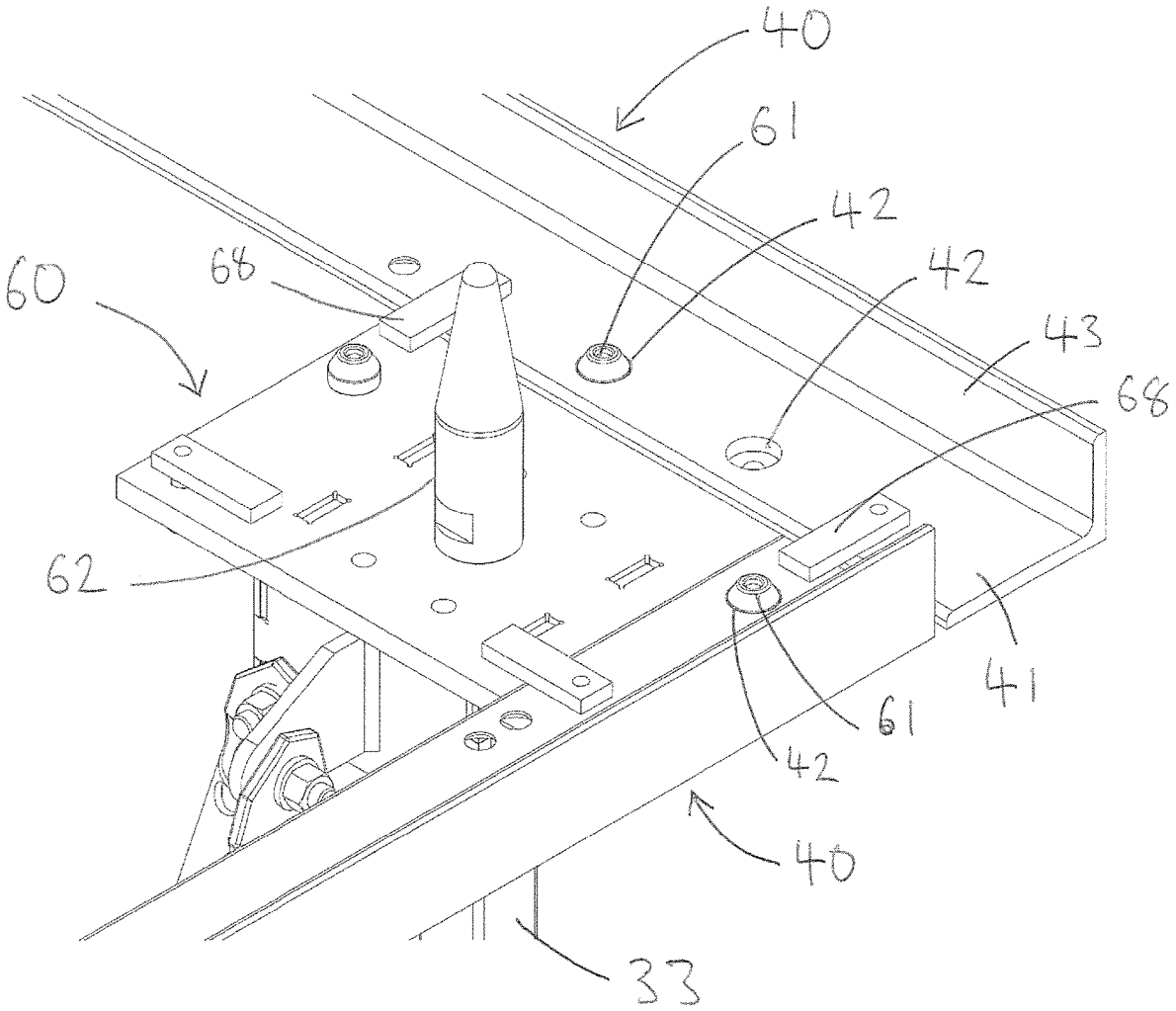
FIG. 2A is an isometric view of a bracket attached to the temporary support member shown in FIG. 1A.
Figure 2B:
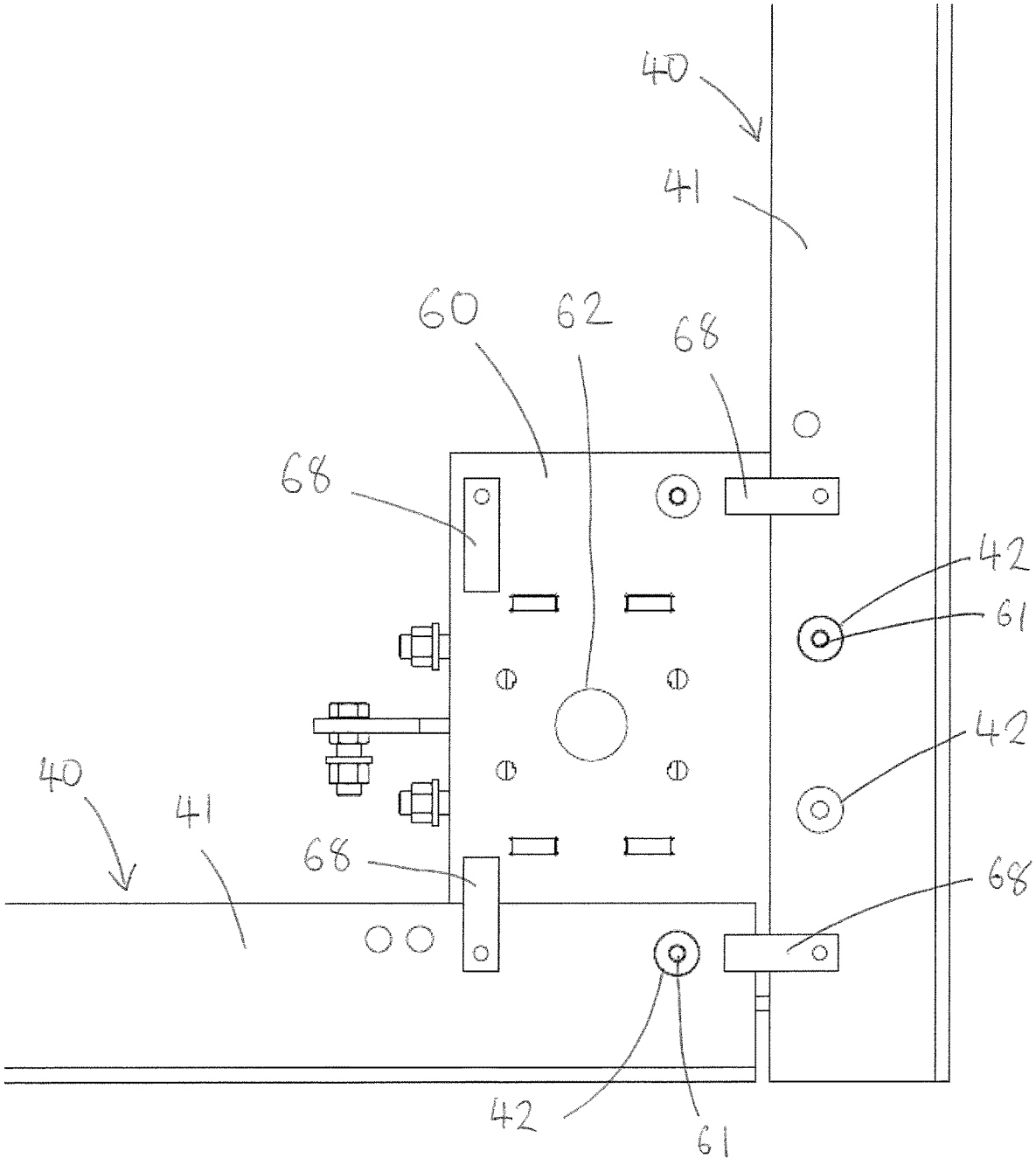
FIG. 2B is a top view of the temporary support member and bracket shown in FIG. 2A.
Figure 2C:
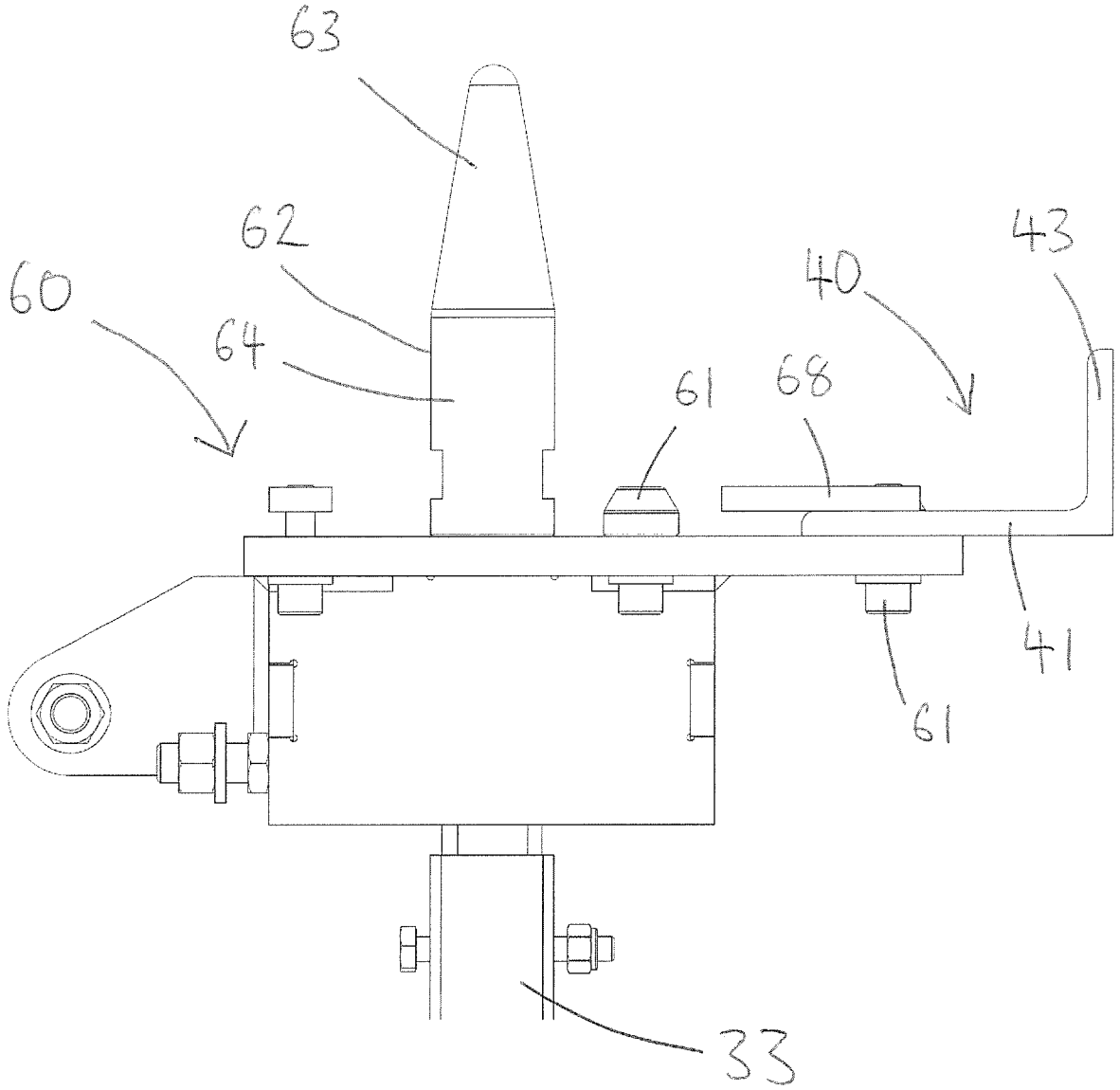
FIG. 2C is a side view of the temporary support member and bracket shown in FIG. 2A.

FIGS. 2A to 2C illustrate the angle bracket 40 attached to the tripod 30. Bracket locators, shown as bolts 61, are used to locate the angle bracket 40 on the locator plate 60. The bolts 61 allow the angle bracket 40 to be quickly and easily located on top of the locating plate 60. The locator plate 60 also has clamp nuts 68 that secure the angle bracket 40 to the locating plate 60. The angle bracket 40 is L-shaped, having a primary section 41 and a secondary section 43. The angle bracket 40 can be a prefabricated channel (PFC). The primary section 41 is substantially perpendicular to the secondary section 43. The L-shaped configuration of the angle bracket 40 allows building components to be attached to the angle bracket 40 at different angles. For example, the base 121 of a second building module could be attached to the primary section 41 of the angle bracket 40, and a wall, perpendicular to the base 121 of the second building module 120, could be attached to the secondary section 43.

The method described above may therefore include attaching an angle bracket 40 to the second end 31 of the tripod 30 by aligning a locating aperture 42 in the angle bracket 40 with a bracket locator, such as bolt 61, on the locating plate 60.

Figure 3A:
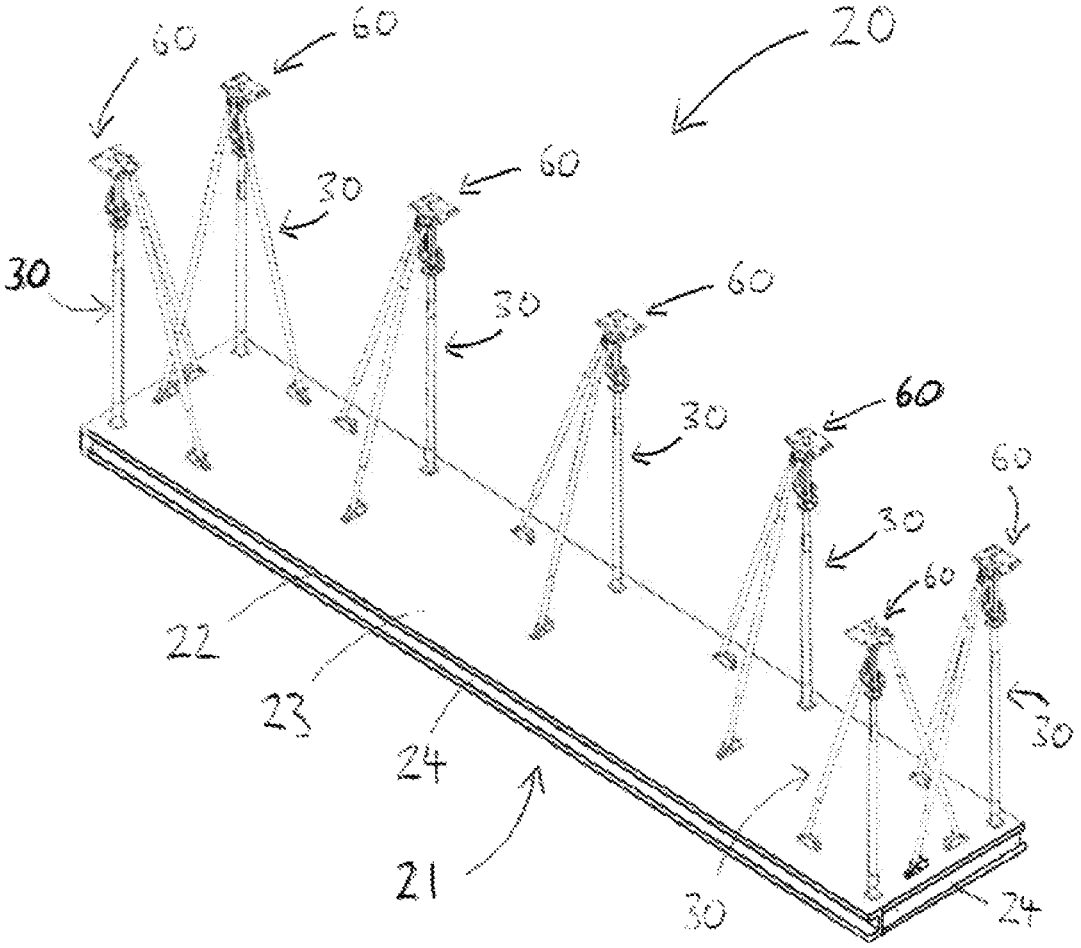
FIG. 3A is an isometric view of a first building module in accordance with an embodiment of the invention.
Figure 3B:
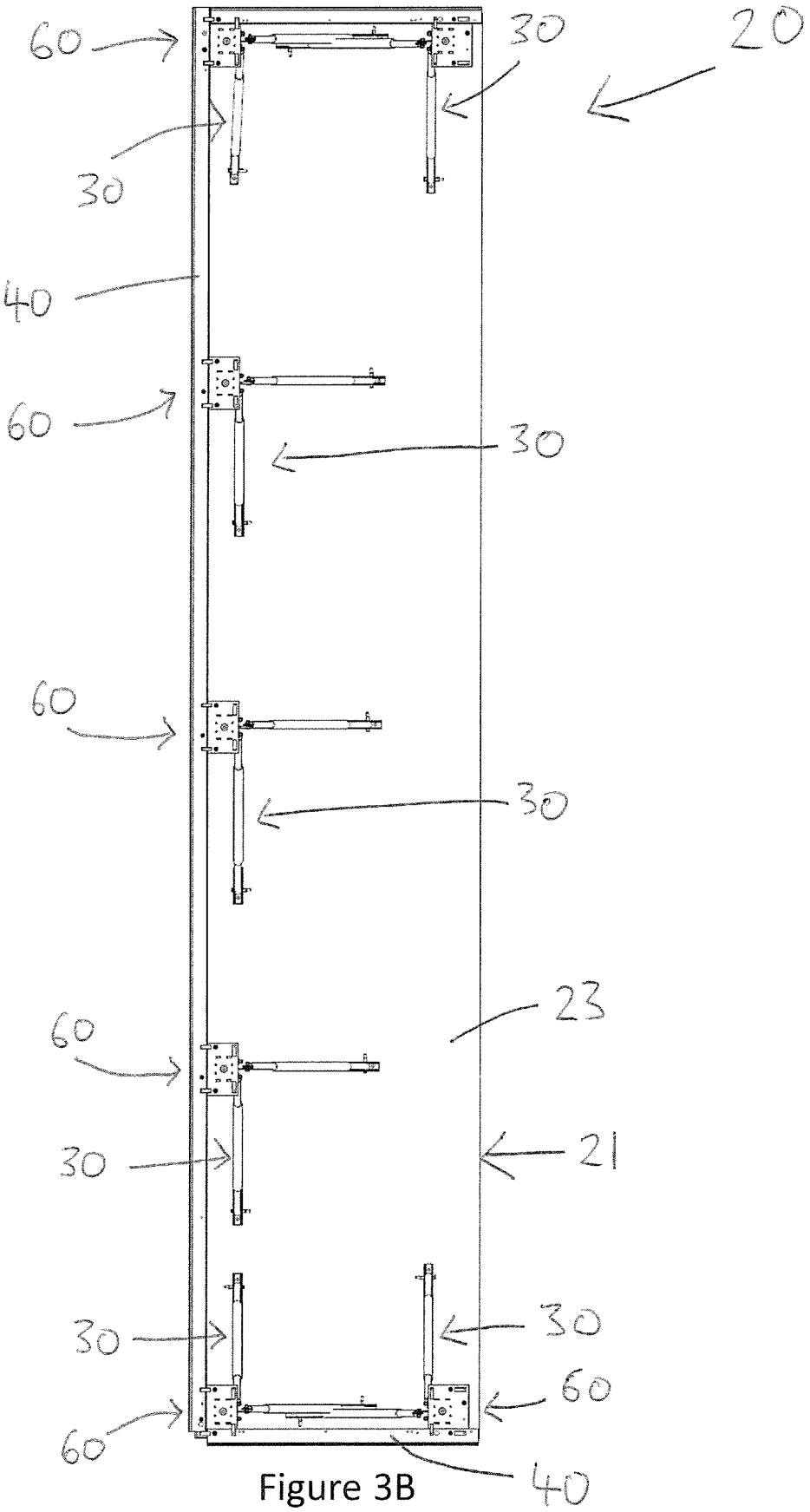
FIG. 3B is a top view of the first building module shown in FIG. 3A with a bracket attached to the temporary support members.
Figure 3C:
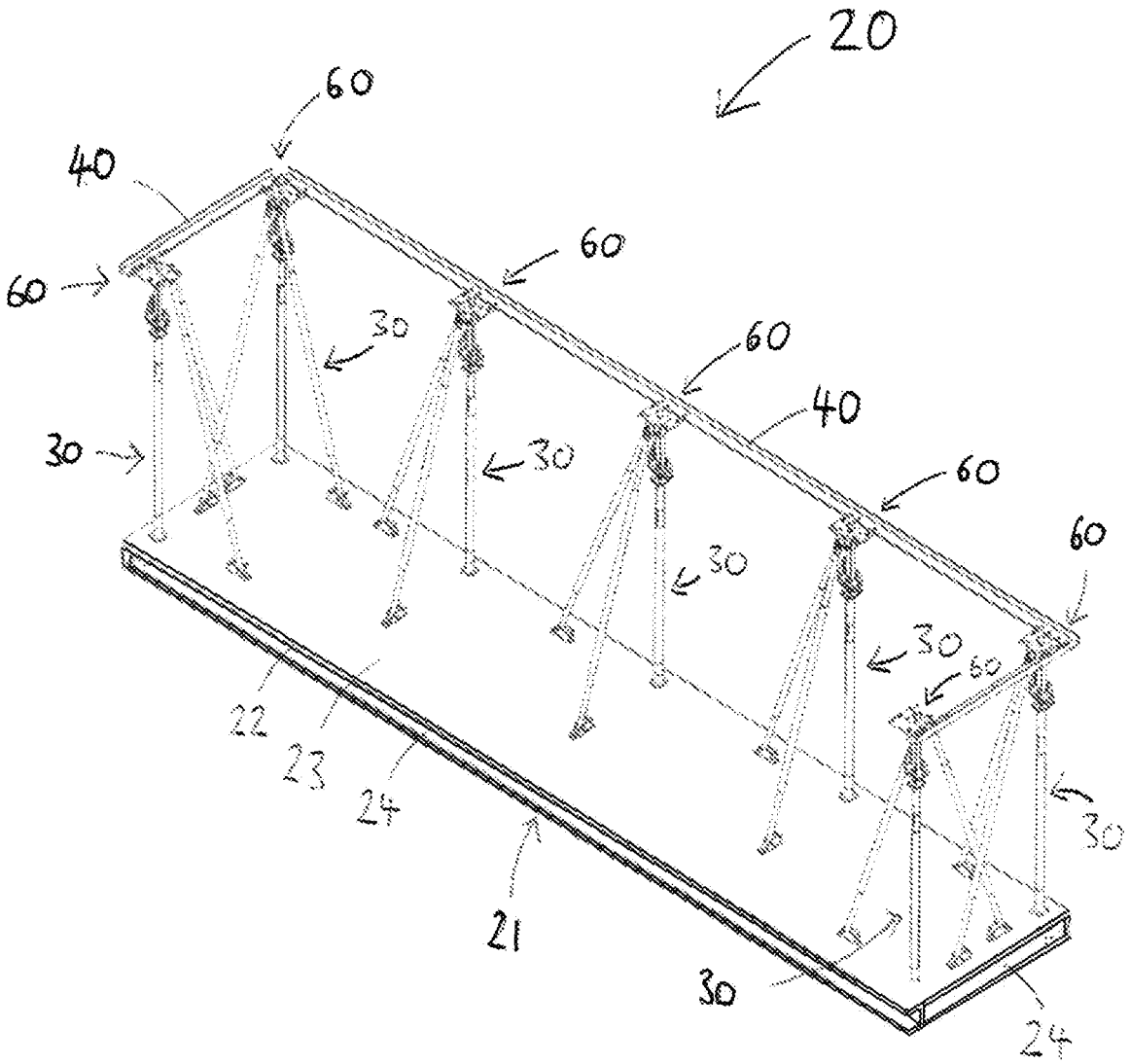
FIG. 3C is an isometric view of the first building module shown in FIG. 3B.

FIGS. 3A to 3C illustrate a first building module 20 having a concrete floor 22. The first building module 20 may also have steel beams 24, or prefabricated channel, cast in around its perimeter or part thereof, which adds rigidity to the concrete floor 22 but which can also double up to act as an angle bracket 40 to which the tripods are attached at an upper end. Tripods 30 are attached to the upper side 23 of the concrete floor 22. The tripods 30 are secured to the concrete floor 22 by bolts that are fastened through apertures 37 in the feet 36 of the tripod 30. The tripods 30 will support a building module above the first building module during construction of the modular building. The number of tripods 30 required will therefore depend on the characteristics of the building, with the requirement that there must be sufficient tripods to support the building module above the tripod 30 before and during concrete application, and the subsequent drying of the concrete. Referring to FIGS. 3B and 3C, an angle bracket 40 is installed on the tripods 30 that extends across multiple tripods 30.

While the tripod spacing depends on the building characteristics, it is envisaged that the spacing between tripods could be less than 8 meters. Alternatively, the spacing between tripods could be less than 6 meters, or between 1 and 3 meters. The spacing is also dependent on the additional structures that the tripods will need to support. For example, if the tripods will also support a façade wall the spacing may be less than if the supports only need to support a second building module above the tripod.

While the angle bracket 40 was discussed as extending across multiple tripods 30, it is envisaged that there could instead be multiple angle brackets 40 with one attached to each tripod 30.

Referring to FIGS. 3A to 5D, an example of constructing two modules of a modular building will now be described in detail. The process begins in a warehouse, where steel beams 24 are positioned on a construction bed/table. Concrete is then poured to form a slab that forms a concrete floor 22. The concrete floor 22 also embeds the steel beams 24 (or prefabricated channel— PFC), which add rigidity to the concrete floor 22 and protects the edges.

Figure 4A:
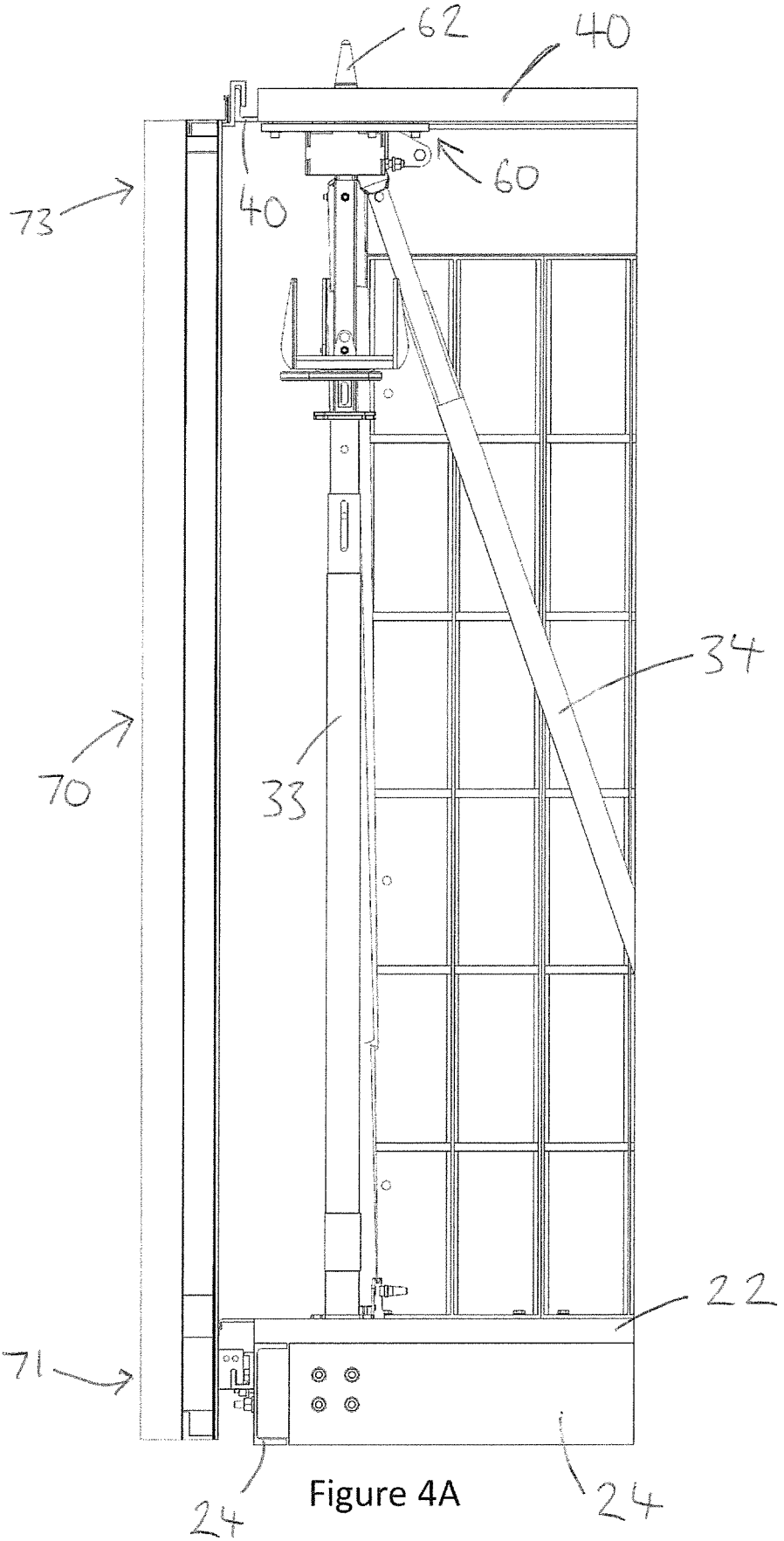
FIG. 4A is a side view of a first building module with a temporary support member and a wall panel (without a building module installed above the first building module)
Figure 4B:
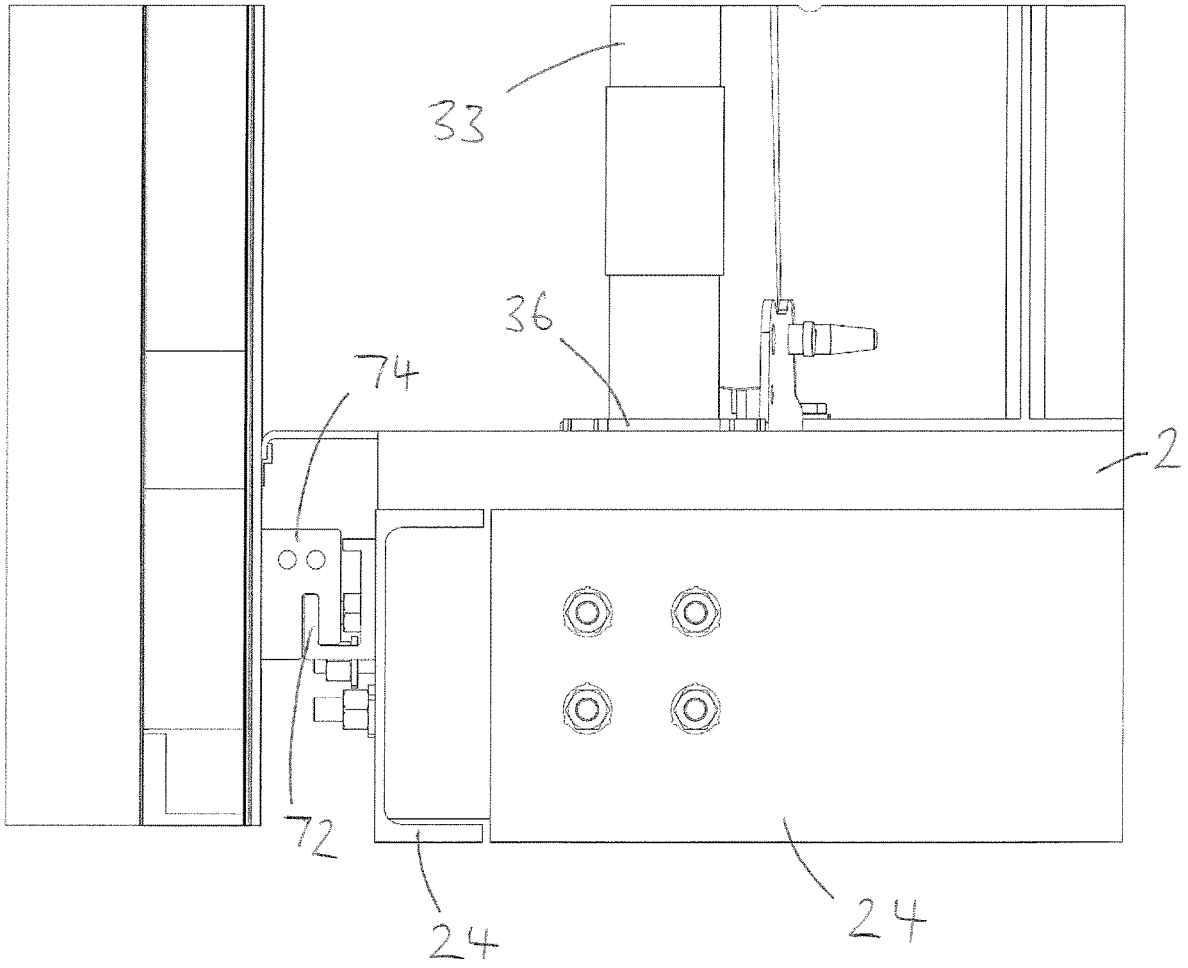
FIG. 4B is a close up side view of connection between the first temporary support member and the first building module shown in FIG. 4A.

It is, however, understood that the slab may be created without a perimeter prefabricated channel steel beams. As shown in FIG. 4A, the steel beams 24 are partially embedded in the concrete floor 22. As shown in FIG. 3A, the steel beams 24 are located at the external perimeter of the concrete floor 22. The concrete floor and the steel beams form a base 21 of a building module.

Once the concrete slab has set the base 21 is removed from the construction bed/table and one or more tripods 30 are placed in position on the upper side 23 of the concrete floor 22 (as shown in FIG. 3A). Bolts are used to attach the tripods 30 to the upper side 23 of the concrete floor 22. The bolts are inserted through apertures 37 in the feet 36 of the tripod 30 and are screwed into the concrete floor 22. The height of the tripod 30 is then adjusted to the desired height. Each of the tripods are adjusted to the same height.

Once the height of all of the tripods 30 has been set the angle bracket 40 is located on the locator plates 60 of the tripods 30, which are at the second end 32 of the tripod 30. Once the angle bracket 40 is in position the angle bracket 40 is secured to the tripod 30 by the clamp nuts 68.

A wall structure, such as a wall panel, and shown as façade wall 70, can be attached to the building module 20 at this stage. To attach the façade wall 70 a façade bracket 72 is fixed to the steel beam 24 of the module base 21, for example by bolts or rivets. A façade wall bracket 74 is attached to a lower end 71 of the façade wall 70 to allow connection to the façade bracket 72. The façade wall 70 has alignment means, shown as alignment bracket 76, located at the upper end 73 of the façade wall 70. The alignment bracket 76 has a channel 77. The façade wall 70 can be lowered into position so that the façade wall bracket 74 contacts and rests on the façade wall bracket 72, and so that the secondary section 43 of the angle bracket 40 is located in the channel 77 of the alignment bracket 76.

It is envisaged that the tripods 30 and the wall structure(s) or wall panel(s) could be attached to the module/base either before or after the first building module is transported to the installation location.

By installing the angle bracket 40 and outer walls to the building module 20 before the module is moved into the installation position the building site can operate with increased safety. This is because the installation of the outer walls removes the live edge of the building site, thereby eliminating a live edge for workers to fall from. In addition, by removing the live edge the construction process also becomes more efficient as there is no need for external barriers to be installed around the building before workers can enter the worksite.

After the angle bracket(s) 40 have been installed on the tripods 30 the first building module 20 is transported from the warehouse to an installation location, such as a building site. The first building module 20 is then installed at the building site (either on the ground floor or above another building module already installed).

Figure 5A:
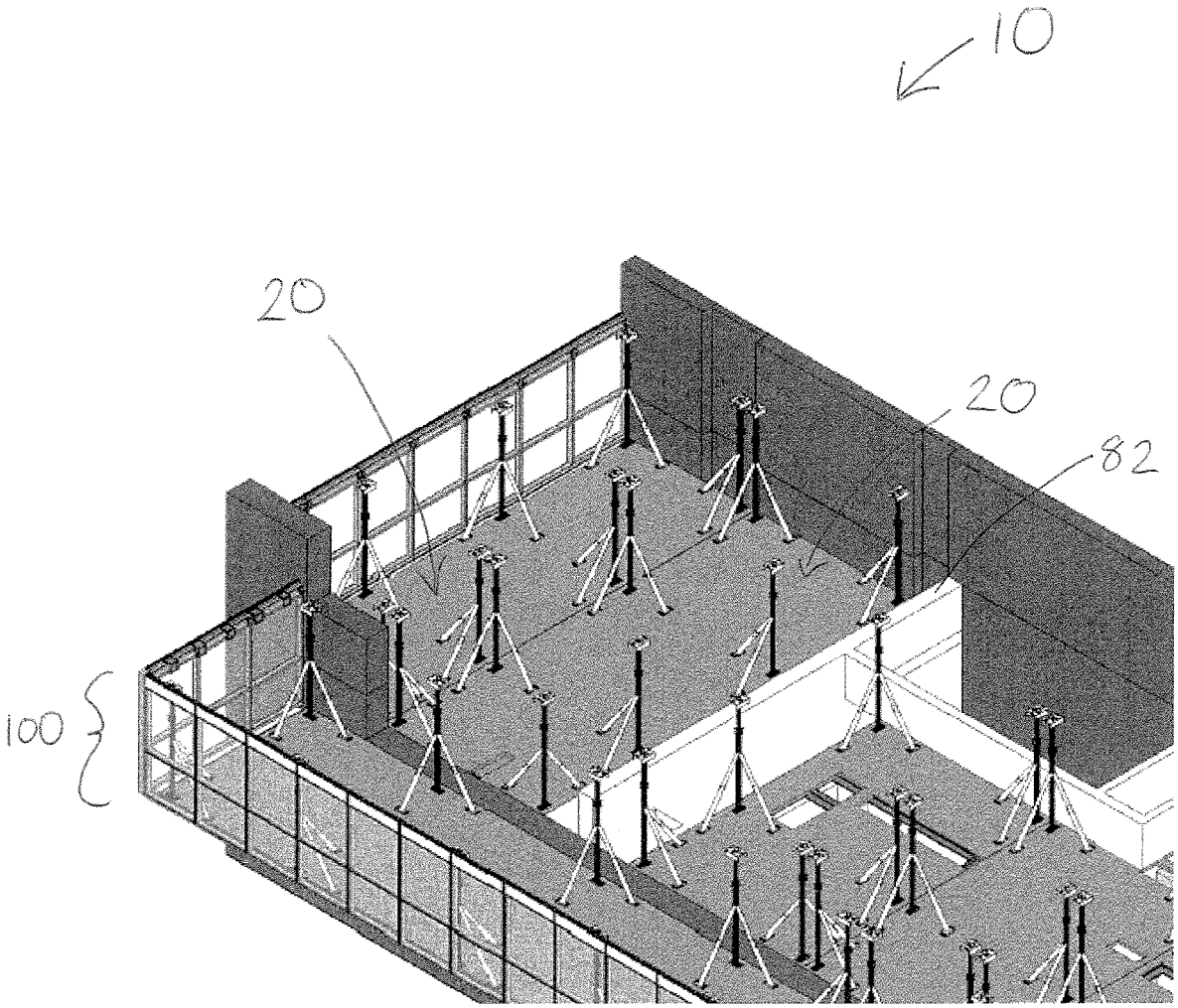
FIG. 5A is an isometric view of a partially constructed modular building with a first building module installed.
Figure 5B:
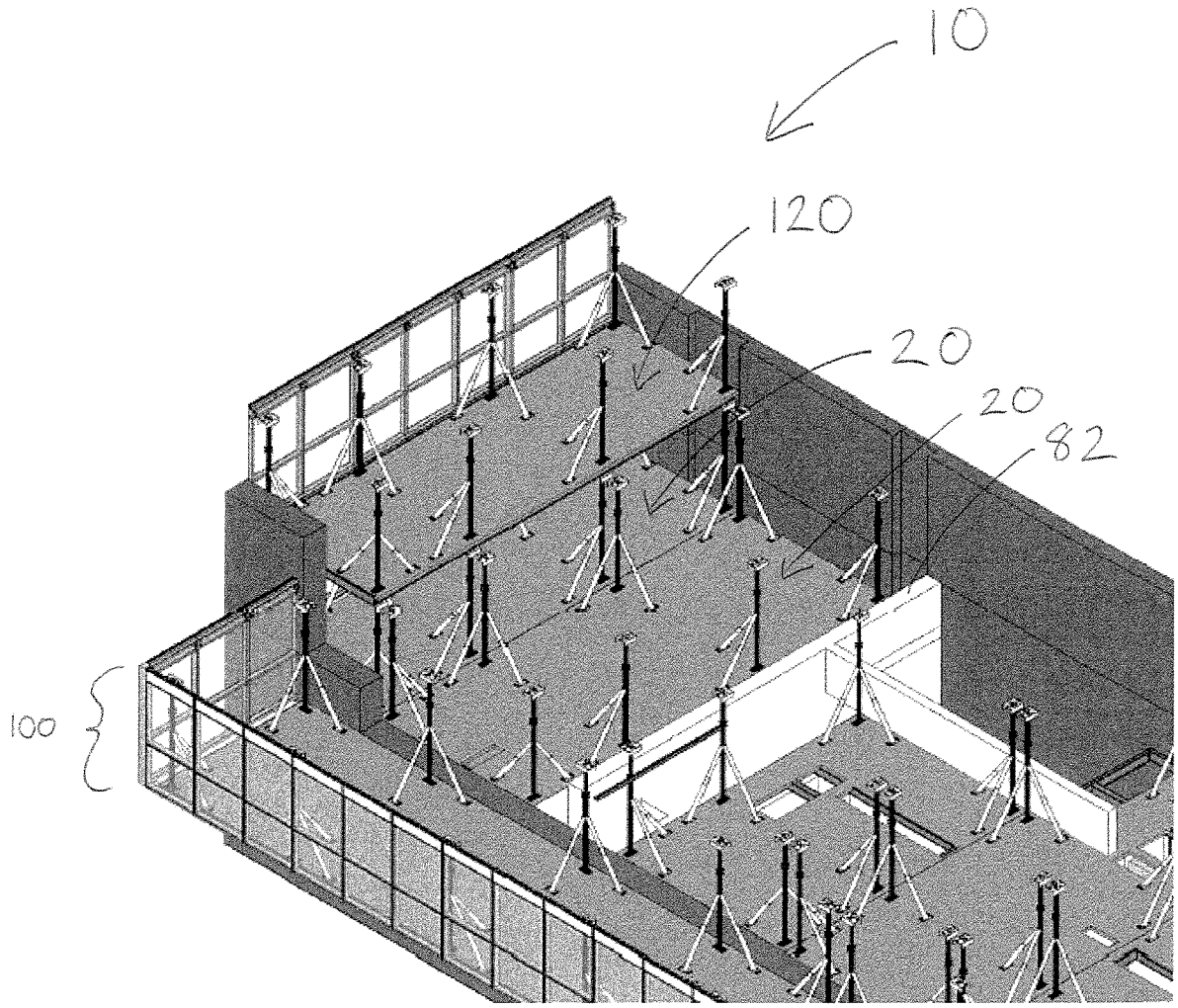
FIG. 5B is an isometric view of the partially constructed modular building shown in FIG. 5A with a second building module installed.

FIG. 5A illustrates a partially constructed modular building in which the first building module 20 has been installed. Referring to FIG. 5B, a second building module 120, which may or may not be similar or identical to the first building module 20, is attached to the primary section 41 of the angle bracket 40 of the first building module 20. In this way at least part of the second building module 120 is installed above, and supported by, the tripod 30, and thereby supported by the first building module 20. The second building module 120 is aligned using the locator pins 62 on the locator plates 60, which are attached to the tripods 30.

Figure 4C:
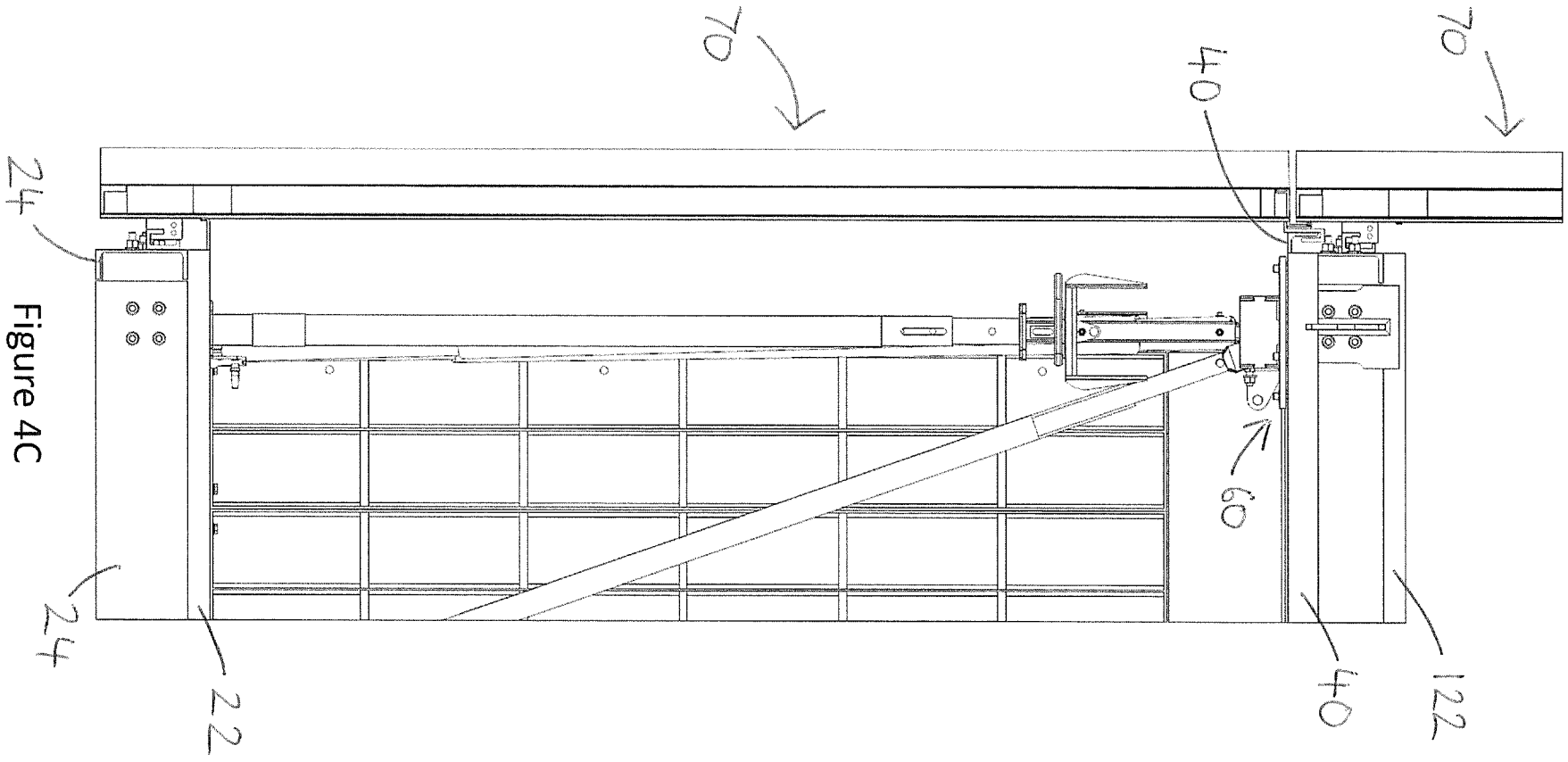
FIG. 4C is a side view of the building module shown in FIG. 4A with a second building module installed above the first building module.
Figure 4D:
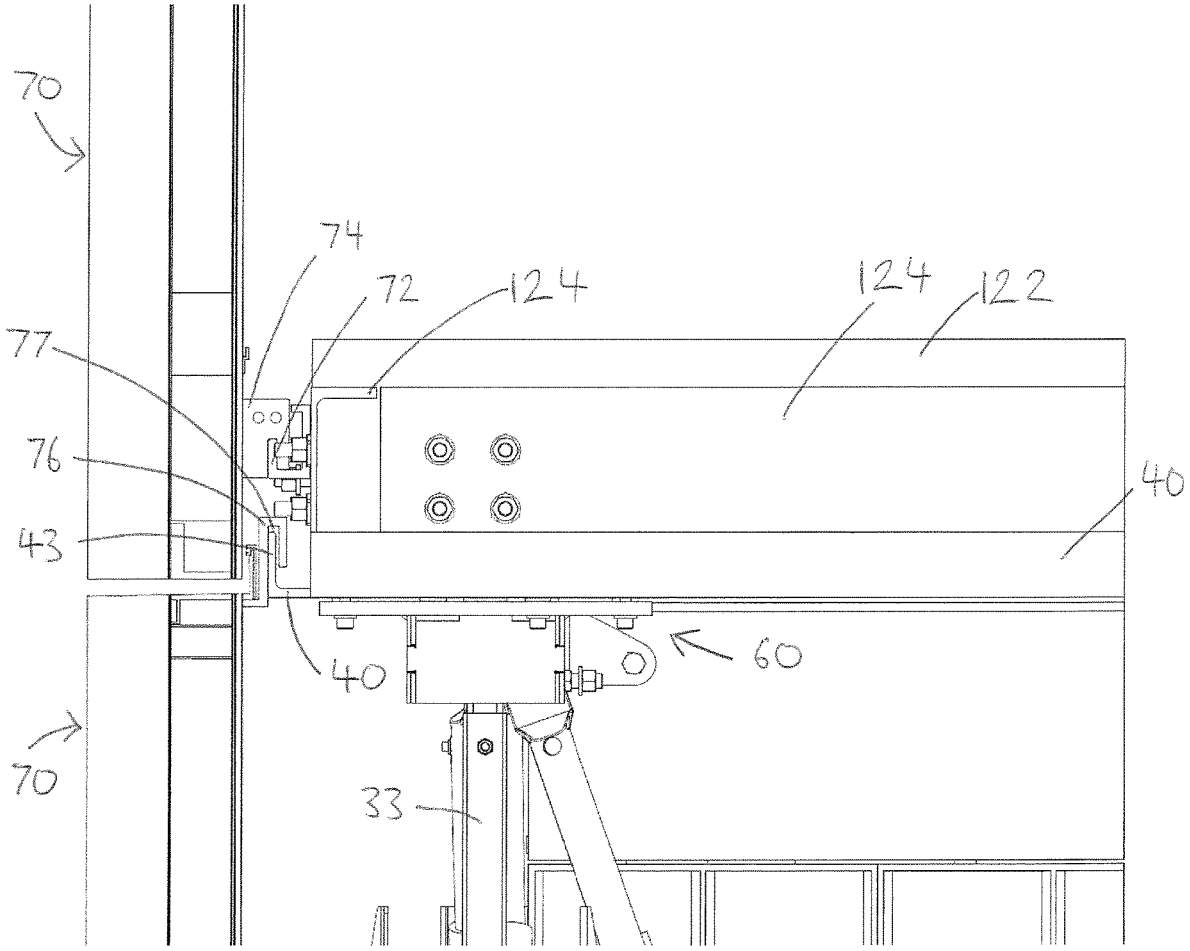
FIG. 4D is a close up side view of the connection between the second building module and the temporary support member shown in FIG. 4C.

The second building module 120 may be installed directly above the first building module 20, as shown in FIG. 5B. FIGS. 4C and 4D illustrate a building module 120 having a base 121 comprising steel beams 124 and a concrete floor 122. During installation of the second building module 120 apertures/holes in the steel beams 124 are located on the locator pins 62 on the locator plates. In other words, the steel beam 24 of the base 121 of the second building module 120 is located on the locator on the tripod 30. Referring to FIG. 4D, one of the steel beams 124 is bolted to the angle bracket 40. In other words, the angle bracket 40 is attached to the second building module 120.

After the second building module 120 is attached to the angle bracket 40 a permanent support member, such as pre-fabricated concrete wall 80, is installed and connected to the first building module 20 and the second building module 120. The permanent support member acts to support at least part of the second building module 120 above the first building module 20. It is envisaged that the permanent support member could be internal structural walls that are built on site. For example, the internal structural walls could be pre-fabricated concrete walls that are installed after the second building module has been installed.

Figure 5C:
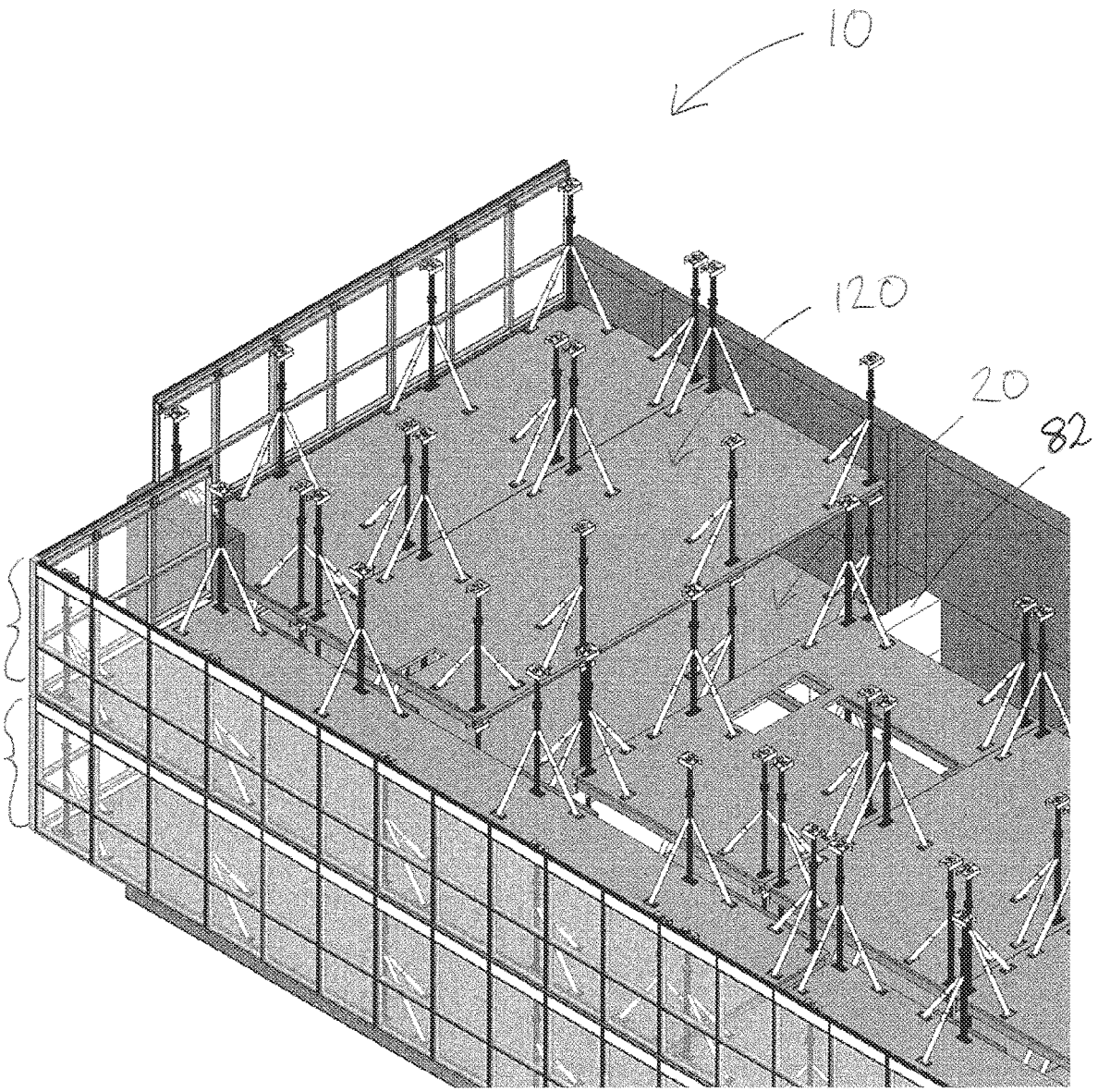
FIG. 5C is an isometric view of a partially constructed modular building with all of the building modules of a first and second levels installed.
Figure 5D:
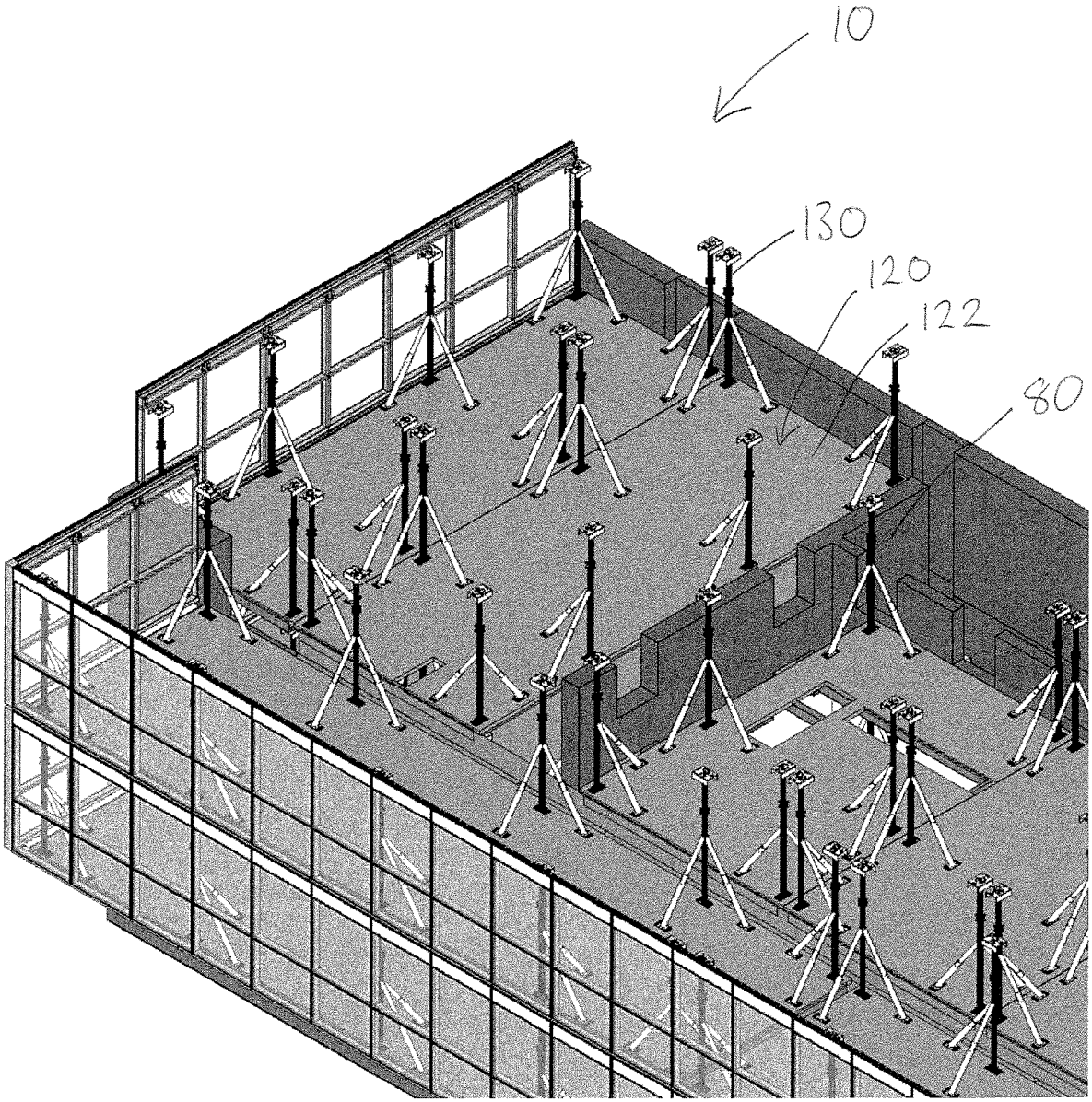
FIG. 5D is an isometric view of the partially constructed modular building in FIG. 5C with a prefabricated panel installed.

Referring to FIGS. 5B to 5D, the installation process of the second building module and the permanent support structure is shown. As shown in FIG. 5B, the pre-fabricated concrete wall 82 from the lower level extends halfway between the first building module 20 and the second building module 120. As shown in FIG. 5C, a second building module 120 is installed above the first building module 20. As shown in FIG. 5D, a pre-fabricated concrete wall 80 is lowered down and placed on top of the pre-fabricated concrete wall 82. This can be achieved by a crane or a suitable hoist. The upper pre-fabricated concrete wall 80 is attached to the lower pre-fabricated concrete wall 82 to form a permanent support structure that can be connected to the first building module 20 and the second building module 120. In other words, the permanent support structure may be formed by one or more pre-fabricated/pre-cast concrete walls/panels.

The permanent support structure is then attached to the first and second building modules 20, 120 so that the permanent support structure supports the second building module 120. This may be achieved by, for example, pouring concrete to connect the first building module 20 and the second building module 120 to the permanent support member. Alternatively, the permanent support structure may be bolted to the building modules 20, 120, for example through the steel beams 24, 124.

As discussed above, the permanent support structure may comprise other forms. For example the support structures may be defined by in situ preparation of core or shear walls using wet concrete that has been poured or sprayed.

Adjacent building modules in a single level can be 'stitched' together, in other words joined together by in situ wet joint connections of concrete, to create a finished floor structure. The in situ formed joints, preferably in the form of beams, are structural joints that contribute to the structural integrity of the building and therefore reduce the amount of vertical support required in the vicinity of the beams. Further information regarding 'stitching' methods can be found in co-pending international patent application no PCT/AU2017/050546, which also claims priority from Australian provisional application no. 2016902460 filed on 23 Jun. 2016 titled "METHODS AND APPARATUS FOR CONSTRUCTING BUILDINGS", and from Australian provisional application no. 2016903025 filed on 1 Aug. 2016 and titled "METHOD FOR CONSTRUCTING A CONCRETE FLOOR IN A MULTISTOREY BUILDING". The description and teachings of that co-pending international patent application is incorporated herein by reference to save reproducing that entire specification herein.

Figure 4E:
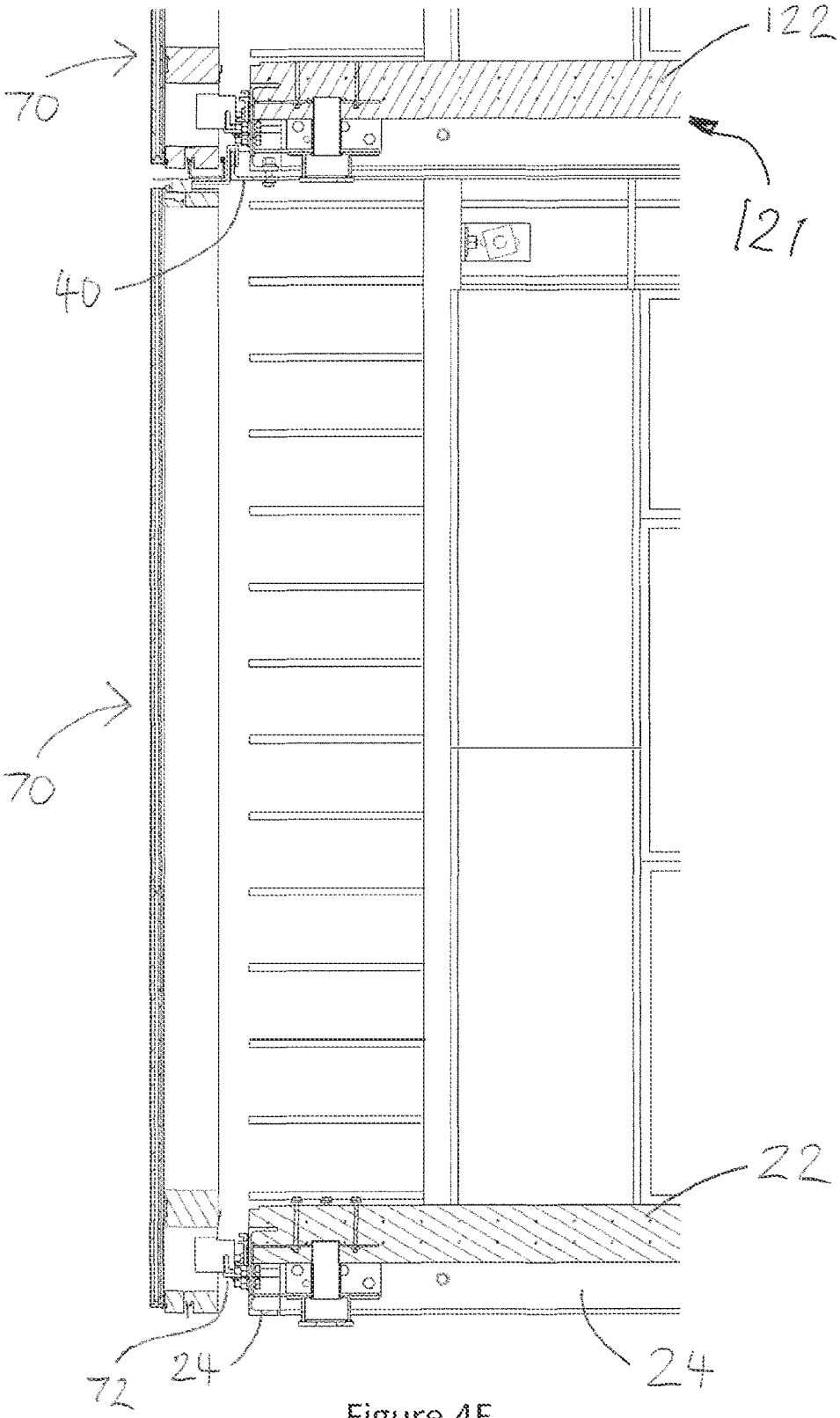
FIG. 4E is a side view of a building module, similar to that shown in FIG. 4C, with the temporary support member removed.

After the permanent support structure is installed the angle bracket 40 is detached from the tripod 30. This is achieved by rotating the clamp nuts 68 out of position so that the angle bracket 40 is free and remains part of the permanent structure. The height of the tripod 30 is then reduced and the bolts removed from the feet 36. The tripod 30 is then removed so that the permanent support member supports the second building module 120. The tripod 30 can then be reused for the next building module. Referring to FIG. 4E, once the tripods 30 have been removed the façade wall 70 is supported at its lower end by a façade bracket 72 attached to the first building module 20, and the angle bracket 40 that is attached to the second building module.

Using temporary support structures, such as the tripods 30, is particularly suitable for tall buildings where concrete walls and columns are needed (smaller buildings can rely more heavily on steel structures), but is still entirely applicable to smaller structures. Suitability can be based on two main reasons: the first being that the building modules require a minimum level of reinforcement and stiffness in order to be transported and/or assembled on site, which later becomes redundant once the concrete walls and columns are in place. The temporary support structures reduce the amount of redundant steel used, thereby making the build more cost effective and more conscious of the environment.

The second reason of the suitability of the presently described method and system is that using temporary support structures decouples the installation of building modules from the installation of the concrete walls and columns, which will often take longer to do as concrete often needs to be poured/sprayed then allowed to set (which can take a week to set).

A benefit of decoupling these processes is that it allows the construction of the building to progress if there are reasons that concrete cannot be poured (due to delays or adverse weather conditions etc.). This can allow a modular building to be completed more quickly by not needing to wait for each level to be fully completed and dried before the modules of the next level can be installed.

It is envisaged that multiple levels could be installed before the permanent support structures are installed. For example, it is envisaged that a build could advance five floors higher than the last permanent support structures before the build would need to stop and wait for permanent support structures to be installed.

It will be understood that in order to decouple the pouring of concrete from the installation of modular building modules on successive level the support members do not need to be temporary support member that are replaced. In other words, the temporary support members could be permanent support members, or they could be support members that become redundant when the building is finished.

FIGS. 1A to 5D therefore also illustrate a method of constructing a modular building including the steps of:

a) constructing a base 21 of a first building module 20;
b) attaching a support member, shown as tripod 30, to the base 21 of the first building module 20;
c) installing the first building module 20;
d) installing a second building module 120 so that at least part of the second building module 120 is supported by the tripod 30; and
e) installing, after step d), a prefabricated panel between the first building module 20 and the second building module 120 to support the second building module 120.

Referring to FIG. 5C, the first building module 20 is part of a first level 100 of the modular building 10 (this could be any floor of the building, not necessarily the $1^{st}$ floor of the building), and the second building module 120 is part of a second level 102 of the modular building and is located above the first building module. As shown in FIGS. 5C and 5D, all of the building modules 20, 120 for the first and the second levels 100, 102 are installed before a prefabricated panel between the first building module 20 and the second building module 120 to support the second building module 120.

As described above, it is envisaged that multiple levels could be installed before the permanent support structures are installed. For example, a second support member, such as a tripod 130, may be attached to the second building module 120, and a third building module (not shown) may be installed at the installation location so that at least part of the third building module is supported by the tripod 130.

In a similar way to that described for the second building module 120, a permanent support structure can be installed to permanently support the third building module above the second building module. The tripods 130 can then be removed from between the second building module 120 and the third building module. It is also envisaged that the third building module could be installed above the second building module 120 before a permanent support structure such as pre-fabricated concrete wall 80, or an in-situ poured/sprayed wall, is installed and/or connected to the first and second building modules 20, 120, and therefore before the tripods 30 between the first building module 20 and the second building module 120 have been removed.

It is understood that reference to "installing" a permanent support structure includes within its scope both the placement of a prefabricated structure, such as a wall 80, or the in-situ creation of a permanent support structure by the application of concrete (by pouring or shotcreteing) to create a column, beam or wall.

It is envisaged that instead of attaching a façade wall 70 to the first building module 20 (as described above) a prefabricated concrete wall could also be attached to the first building module 20. Alternatively, the outer wall could be constructed on site as a shotcrete wall. If a shotcrete wall is desired a bracket for supporting a mesh made from reinforcing steel bar (rebar) may be installed on the first building module 20 to reinforce the concrete wall, either before or after transporting the first building module 20 to the installation location.

Figure 6A:
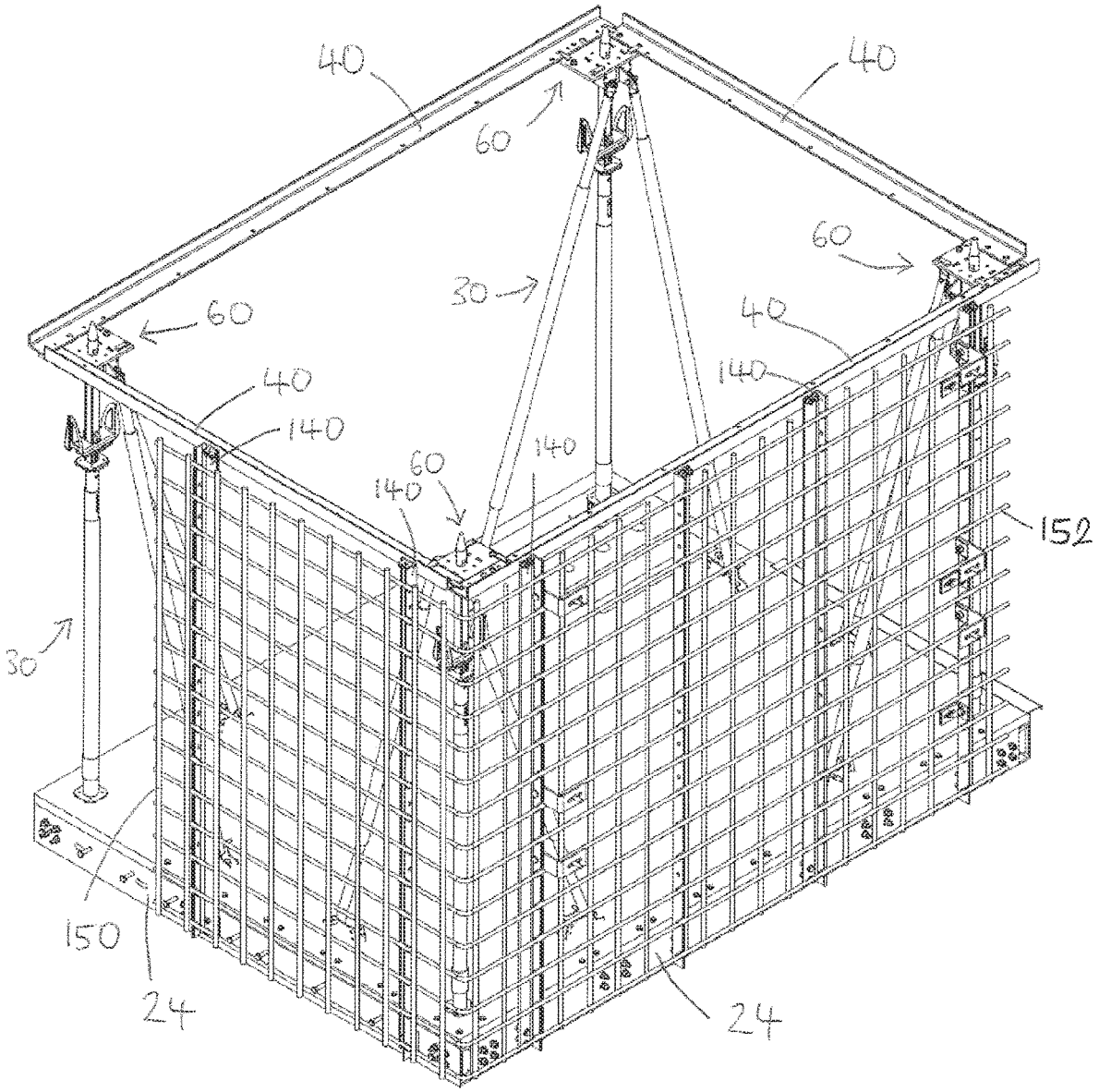
FIG. 6A is an isometric view of a building module with a rebar bracket and a rebar mesh attached to the bracket shown in FIG. 2A and the temporary support member shown in FIG. 1A.
Figure 6B:
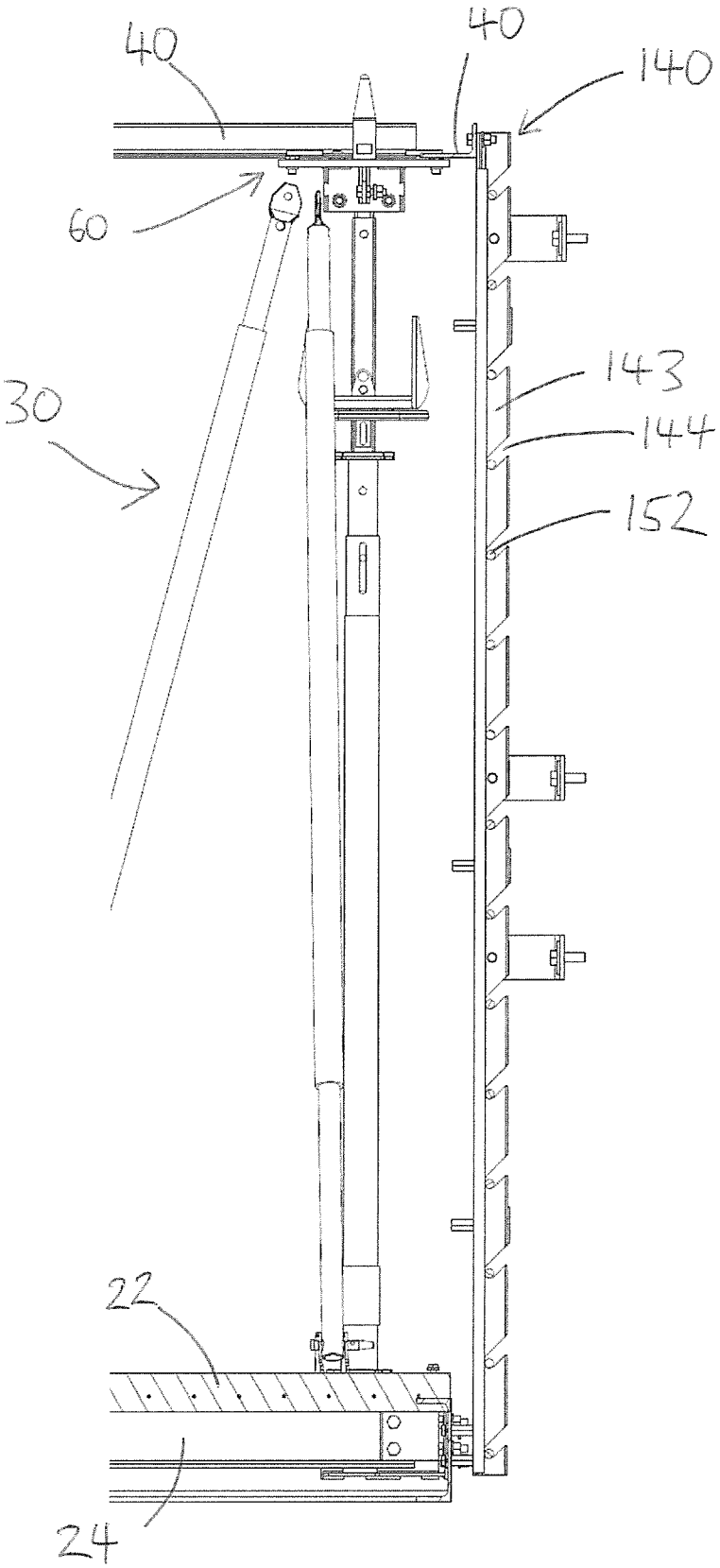
FIG. 6B is a side view of the building module shown in FIG. 6A.
Figure 6C:
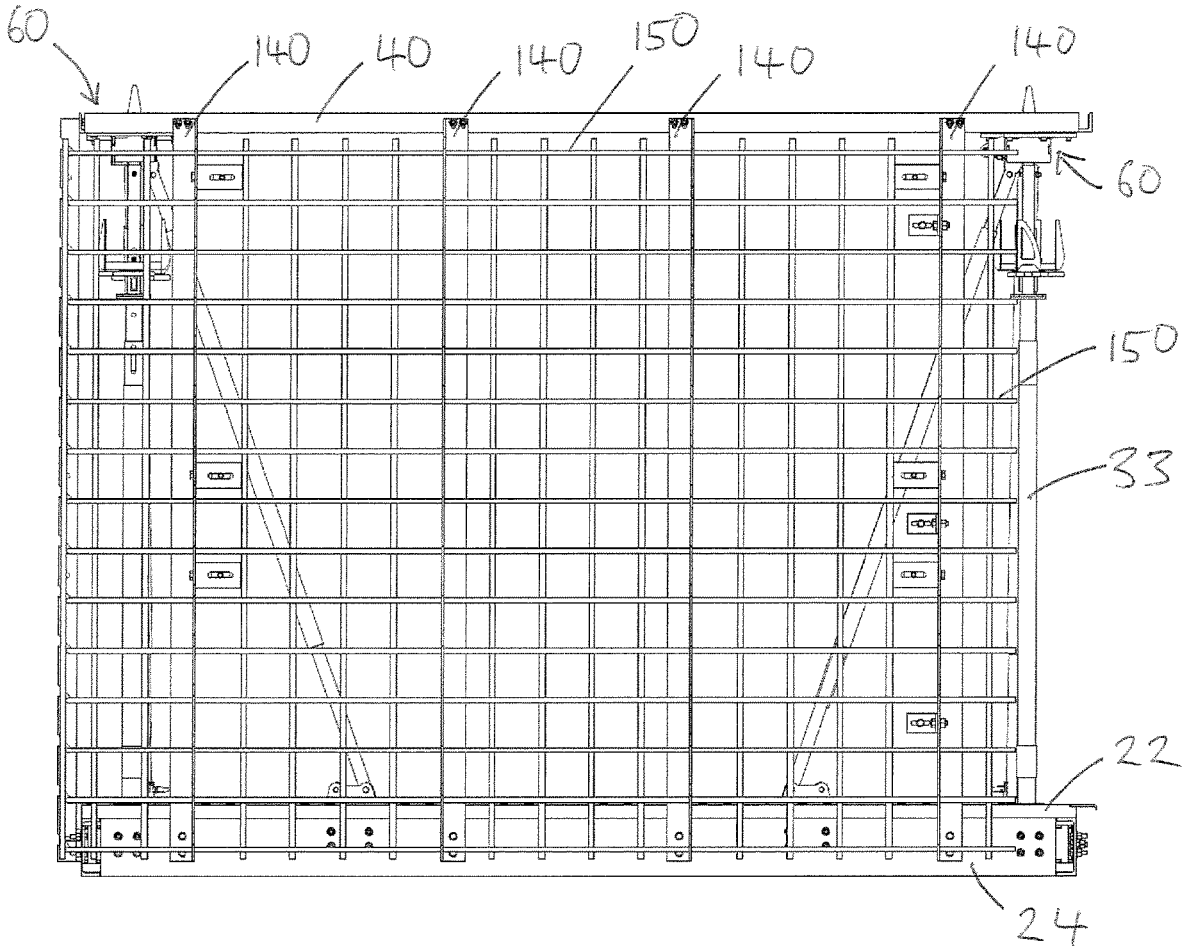
FIG. 6C is a top view of the building module shown in FIG. 6A.
Figure 6D:
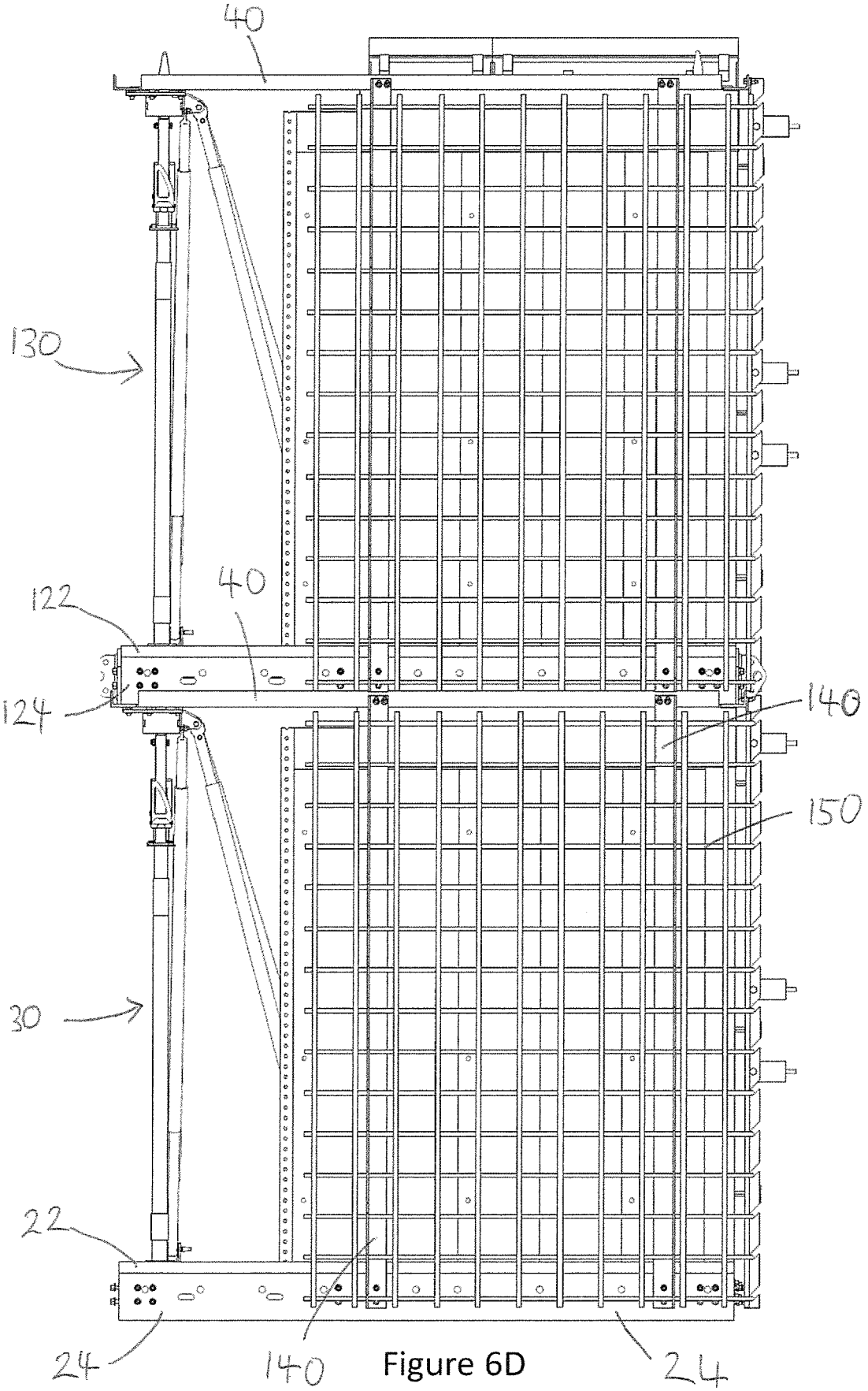
FIG. 6D is a front view of two levels of a modular building having rebar brackets and a rebar mesh attached to brackets shown in FIG. 2A and temporary support members shown in FIG. 1A.
Figure 6E:
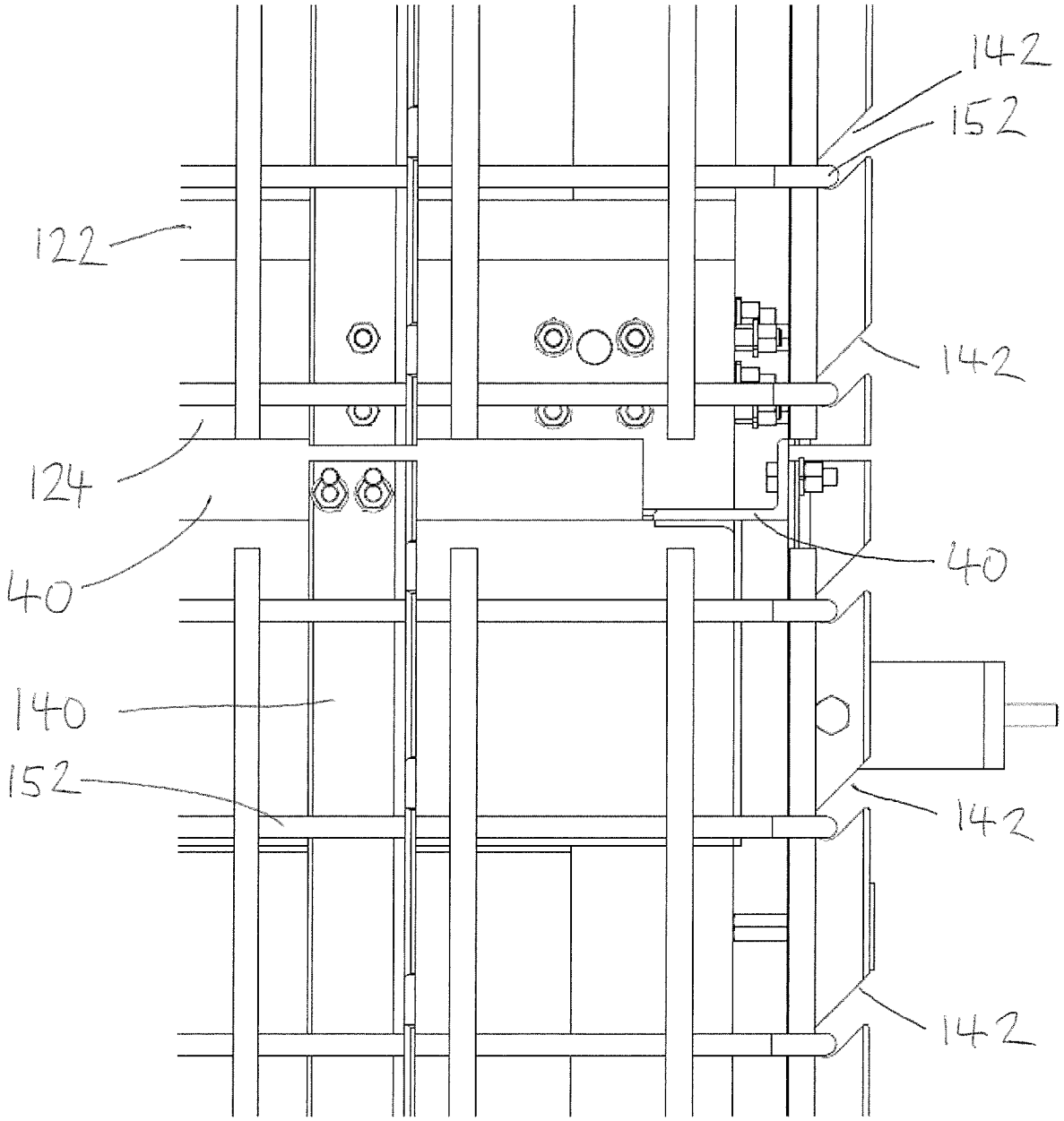
FIG. 6E is a close up side view of the connection between the rebar bracket and the bracket shown in FIG. 2A.

FIGS. 6A to 6E illustrates a first building module 20 in which the façade wall 70 is replaced by a bracket, shown as rebar bracket 140 and a rebar mesh 150. The rebar bracket and rebar mesh are used to create a shotcrete wall. The rebar bracket 140 has an elongate body 141 comprising an attaching section 142 and a supporting section 143. The attaching section 142 and the supporting section 143 are perpendicular and form an L-shaped extruded cross-section. Referring to FIGS. 6B and 6E, the supporting section 143 has a supporting means, shown as slots 144. The slots 144 extend into the supporting section 143 and are open at one end to allow a rebar mesh 150 to be inserted into the slots 144 so that the rebar mesh 150 is supported by the slots 144. The slots 144 are also angled downwards so that when the rebar mesh 150 is inserted into the slots 144 gravity holds the rebar mesh in the slots 144.

Referring to FIG. 6A, two rebar brackets 140 are attached to the angle bracket 40 and the steel beam 24 of the first building module (see above for a more detailed description of the angle bracket 40 and the steel beam 24). Spacers 145 are used to distance the rebar brackets 140 from the angle bracket 40 and the steel beam 24. As shown in FIG. 6A, the rebar mesh 150 is supported between the two rebar brackets 140. Horizontal sections 152 of the rebar mesh 150 are located in the slots 144 in the rebar bracket 140. The slots 144 in the rebar brackets 140 are spaced apart so that each of the horizontal sections 152 of the rebar mesh has a corresponding slot 144.

It is envisaged that splice bars (not shown) made from rebar (splice rebar) could be removably attached to the rebar mesh 150. The splice bars can have a bent section at one end of the splice bar that allows the splice bar to be hooked onto the rebar mesh 150. The splice bars could be temporarily attached to the rebar mesh 150 in other ways during transportation (e.g. tied down), however the hooked splice bars provide a quick and easy solution for attachment. The splice bars may be hooked onto the rebar mesh 150 in the warehouse when the rebar mesh 150 is located in the rebar brackets 140. This ensures that the splice bars are ready to be used on site once the first building module is installed. Alternatively, the rebar mesh 150 and splice bars may be installed once the first building module 20 has been installed at an installation location.

FIG. 6D illustrates two levels of a modular building, each level having two rebar brackets 140 and a rebar mesh 150. Once the rebar mesh 150 is installed in the slots of the rebar brackets 140, the slice bars (not shown) can be removed and used to splice the rebar mesh in the lower level to the rebar mesh in the upper level to form a continuous mesh between the two levels. If another rebar mesh 150 is positioned to the left or right of the rebar mesh 150 shown in FIG. 6D then the splice bars can also be used to splice together side-by-side sections of rebar mesh. In other words, the splice bars allow adjacent sections of rebar mesh 150 to be spliced together to form a continuous section of rebar mesh.

By using the rebar brackets 140 and the rebar mesh 150 there is no need to weld the rebar mesh 150 to other parts of the partially built building structure (welding is more expensive and time intensive than splicing). This is advantageous as it can reduce the amount of time taken to construct a shotcrete wall. There is also no need for a construction worker to hold and locate the rebar, which is required when attaching mesh rebar in more conventional buildings. This allows larger sections of rebar mesh to be used when utilising the rebar brackets 140. It is envisaged that the rebar bracket 140 and the rebar mesh 150 could also be used to assist in constructing internal walls. Shutters may also be installed on the module 20 to allow concrete walls to be poured, rather than using a shotcrete process.

While the supporting means is described as slots, it is envisaged that the supporting means could be any other suitable supporting member, such as a hook. In addition, while the rebar mesh 150 has been described as extending between two rebar brackets that extend from the angle bracket 40 to the steel beam 24, it is envisaged that one or more of the brackets would not extend from the angle bracket 40 to the steel beam 24, and may be suspended from the angle bracket alone or attached to the steel beam alone. It is also envisaged that instead of the wall being a shotcrete wall, the wall may be a poured wall.

It is to be understood that, if any prior art publication is referred to herein, such reference does not constitute an admission that the publication forms a part of the common general knowledge in the art, in Australia or any other country In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of constructing a modular multi-storey building, the method comprising:

assembling first and second building modules in a vertical arrangement at an installation location to form a multi-storey building structure, wherein the building modules are fabricated offsite to the installation location at a first location and comprise a base component for forming part of a floor and a façade wall, wherein the façade wall is attached to and supported by a connection extending along a side edge of the base component such that the connection bears the load of the façade wall at the side edge of the base component during transportation from the first location to the installation location, the connection being partially embedded along the side edge of the base component and having a bracket attached to the façade wall such that the façade wall extends vertically upward along the side edge of the base component;

vertically supporting at least part of the second building module above the first building module using temporary support members between the first and second building modules;

installing a permanent support structure between, the first and second building modules to vertically support the second building module above the first building module;

removing the temporary support members; and installing the permanent support structure after the second building module has been assembled in a vertical arrangement above the first building module at the installation location, wherein installing the permanent support structure includes installing a prefabricated concrete component.

2. The method claimed in claim 1, including at least partially fabricating the first building module at the first location before assembling the first and second building modules at the installation location.

3. The method claimed in claim 1, including attaching the temporary support members to the first building module at the first location.

4. The method claimed in claim 1, including attaching an upper bracket across an upper end of the temporary support members.

5. The method claimed in claim 4, including attaching the façade wall to the upper bracket.

6. The method claimed in claim 4, including attaching the upper bracket to the second building module.

7. The method claimed in claim 1, including assembling a third building module above the second building module before the permanent support structure is connected to the first and second building modules.

8. The method claimed in claim 7, including assembling the third building module above the second building module using temporary support members.

9. The method claimed in claim 1, including casting the base component of the second building module to include a steel beam at least partially embedded into the perimeter of the base of the second building module.

10. The method claimed in claim 9, including locating the steel beam of the base of the second building module on a locator on one or more of the temporary support members.

11. The method claimed in claim 1, including pouring concrete to connect the first and/or second building module to the permanent support member.

12. The method claimed in claim 1, including re-using the temporary support members for higher levels of the multi-storey building.

13. The method claimed in claim 1, including aligning the second building module onto a locator on one or more of the temporary support members, which temporary support members are attached to the first building module.

14. The method claimed in claim 1, including locating an alignment means at an upper end of the facade wall adapted to align with a second building module above the first building module, the alignment means having an alignment bracket with a channel.

15. The method claimed in claim 14, including vertically lowering the second building module onto the first building module, such that a locating bracket on the base component of the second building module locates into the channel of the alignment bracket of the first module.

16. A method of constructing a modular multi-storey building, the method comprising: assembling first and second building modules in a vertical arrangement at an installation location to form a multi-storey building structure, wherein the building modules are fabricated offsite to the installation location at a first location and comprise a base component for forming part of a floor and a façade wall, wherein the façade wall is attached to and supported by a connection extending along a side edge of the base component such that the connection bears the load of the façade wall at the side edge of the base component during transportation from the first location to the installation location, the connection being partially embedded along the side edge of the base component and having a bracket attached to the façade wall such that the façade wall extends vertically upward along the side edge of the base component;

vertically supporting at least part of the second building module above the first building module using temporary support members between the first and second building modules;

installing a permanent support structure between the first and second building modules to vertically support the second building module above the first building module;

removing the temporary support members; and installing the permanent support structure after the second building module has been assembled in a vertical arrangement above the first building module at the installation location, wherein installing the permanent support structure includes creating a concrete component by the in-situ application of concrete.

17. The method claimed in claim 16, including at least partially fabricating the first building module at the first location before assembling the first and second building modules at the installation location.

18. The method claimed in claim 16, including attaching the temporary support members to the first building module at the first location.

19. The method claimed in claim 16, including re-using the temporary support members for higher levels of the multi-storey building.

20. The method claimed in claim 16, including aligning the second building module onto a locator on one or more of the temporary support members, which temporary support members are attached to the first building module.

* * * * *